US009938935B2

(12) United States Patent
Bailey et al.

(10) Patent No.: US 9,938,935 B2
(45) Date of Patent: Apr. 10, 2018

(54) EXHAUST GAS RECIRCULATION SYSTEM AND METHOD

(71) Applicant: General Electric Company, Schenectady, NY (US)

(72) Inventors: Kevin Paul Bailey, Mercer, PA (US); Eric David Peters, Erie, PA (US); Ian Prechtl, Dunkirk, NY (US); Justin Lee, Thornton, CO (US); Jared Lossie, Erie, PA (US); Uday Prakash Karmakar, Erie, PA (US); Vijayaselvan Jayakar, Bangalore (IN); David Wright, Decatur, TX (US)

(73) Assignee: General Electric Company, Schenectady, NY (US)

( * ) Notice: Subject to any disclaimer, the term of this patent is extended or adjusted under 35 U.S.C. 154(b) by 180 days.

(21) Appl. No.: 15/086,618

(22) Filed: Mar. 31, 2016

(65) Prior Publication Data

US 2016/0208744 A1 Jul. 21, 2016

Related U.S. Application Data

(63) Continuation-in-part of application No. 13/548,163, filed on Jul. 12, 2012, now Pat. No. 9,309,801.
(Continued)

(51) Int. Cl.
*F02M 26/30* (2016.01)
*F01P 7/16* (2006.01)
(Continued)

(52) U.S. Cl.
CPC ..... *F02M 26/30* (2016.02); *F01P 7/16* (2013.01); *F01P 2050/06* (2013.01);
(Continued)

(58) Field of Classification Search
CPC ..... F02M 26/30; F02M 26/28; F02M 26/14; F02M 26/11; F01P 7/16; F01P 2060/16; F01P 2050/06
See application file for complete search history.

(56) References Cited

U.S. PATENT DOCUMENTS 4,258,687 A 3/1981 Mauch et al.
5,004,042 A 4/1991 McMorries, IV et al.
(Continued)

FOREIGN PATENT DOCUMENTS

CN 1233313 A 10/1999
DE 19629015 A1 1/1998
(Continued)

OTHER PUBLICATIONS

"Seals Eastern Inc. Website," Available Online at www.sealseastern.com, Available as Early as Jan. 16, 2000, Retrieved Dec. 3, 2015, 2 pages.
(Continued)

*Primary Examiner* — Stephen K Cronin
*Assistant Examiner* — Xiao Mo
(74) *Attorney, Agent, or Firm* — GE Global Patent Operation; John A. Kramer

(57) ABSTRACT

Various methods and systems are provided for an exhaust gas recirculation system. In one example, an exhaust gas recirculation cooler includes an exhaust gas inlet and an exhaust gas outlet spaced from the exhaust gas inlet; a plurality of cooling tubes disposed between the exhaust gas inlet and exhaust gas outlet; and a baffle positioned proximate to the exhaust gas inlet and interposed between the plurality of cooling tubes and the exhaust gas inlet, where the baffle directs exhaust gas entering the EGR cooler through the exhaust gas inlet to the plurality of cooling tubes in a defined path.

20 Claims, 11 Drawing Sheets

Related U.S. Application Data

(60) Provisional application No. 62/141,624, filed on Apr. 1, 2015.

(51) Int. Cl.
*F02M 26/11* (2016.01)
*F02M 26/14* (2016.01)
*F02M 26/28* (2016.01)

(52) U.S. Cl.
CPC ..... *F01P 2060/16* (2013.01); *F02M 26/11* (2016.02); *F02M 26/14* (2016.02); *F02M 26/28* (2016.02)

(56) References Cited

U.S. PATENT DOCUMENTS

| | | | | |
|---|---|---|---|---|
| 6,286,482 | B1 | 9/2001 | Flynn et al. | |
| 6,748,906 | B1 | 6/2004 | White et al. | |
| 7,421,983 | B1 | 9/2008 | Taylor | |
| 8,376,033 | B2 | 2/2013 | Robidou et al. | |
| 8,857,156 | B2 | 10/2014 | Primus et al. | |
| 8,903,632 | B2 | 12/2014 | Peters et al. | |
| 2001/0017127 | A1 | 8/2001 | Flynn et al. | |
| 2005/0098307 | A1 | 5/2005 | Goto | |
| 2005/0188965 | A1 | 9/2005 | Usui | |
| 2005/0274501 | A1 | 12/2005 | Agee | |
| 2006/0005791 | A1 | 1/2006 | Obidi | |
| 2006/0065870 | A1 | 3/2006 | Mori et al. | |
| 2006/0200297 | A1 | 9/2006 | Liu et al. | |
| 2007/0056282 | A1 | 3/2007 | Iwaszkiewicz | |
| 2007/0131401 | A1 | 6/2007 | Daly et al. | |
| 2007/0157893 | A1 | 7/2007 | Wei et al. | |
| 2007/0227141 | A1 | 10/2007 | Ma et al. | |
| 2009/0318039 | A1 | 12/2009 | Hays | |
| 2010/0050631 | A1* | 3/2010 | Yager | F01N 5/02 60/604 |
| 2011/0185714 | A1 | 8/2011 | Lohbreyer et al. | |
| 2011/0308778 | A1 | 12/2011 | Tsuda et al. | |
| 2015/0047619 | A1 | 2/2015 | Fetzer et al. | |
| 2016/0273840 | A1 | 9/2016 | El Hajal et al. | |
| 2017/0152815 | A1* | 6/2017 | Peters | F02M 26/29 |
| 2017/0276094 | A1* | 9/2017 | Sheth | B21D 41/028 |

FOREIGN PATENT DOCUMENTS

| | | | |
|---|---|---|---|
| DE | 20318321 | U1 | 3/2004 |
| DE | 102006019282 | A1 | 10/2007 |
| EP | 2039923 | A1 | 3/2009 |
| JP | 2007170271 | A | 7/2007 |
| WO | 2011073589 | A2 | 6/2011 |
| WO | 2012125154 | A1 | 9/2012 |

OTHER PUBLICATIONS

"AFLAS Fluoroelastomers Website," Available Online at www.aflas.com, Available as Early as Dec. 6, 2000, Retrieved Dec. 3, 2015, 2 pages.

ISA European Patent Office, International Search Report and Written Opinion Issued in Application No. PCT/US2013/047516, dated Jan. 10, 2013, WIPO, 9 pages.

Unofficial English Translation of Chinese Office Action issued in connection with related CN Application No. 201380037204.6 dated Sep. 27, 2016.

PCT Search Report and Written Opinion issued in connection with related Application No. PCT/US2016/025234 dated Jul. 14, 2016.

* cited by examiner

EXHAUST GAS RECIRCULATION SYSTEM AND METHOD

CROSS REFERENCE TO RELATED APPLICATIONS

This application claims priority to U.S. Provisional Application No. 62/141,624, entitled "EXHAUST GAS RECIRCULATION SYSTEM AND METHOD," filed Apr. 1, 2015, and is a continuation-in-part of U.S. application Ser. No. 13/548,163, entitled, "SYSTEMS AND METHODS FOR A COOLING FLUID CIRCUIT," filed Jul. 12, 2012 and to be issued as U.S. Pat. No. 9,309,801 on Apr. 12, 2016, the entire contents of each of which are hereby incorporated by reference for all purposes.

BACKGROUND

1. Technical Field

Embodiments of the subject matter described herein relate to an exhaust gas recirculation (EGR) system, a cooler for that system, and associated methods.

2. Discussion of Art

Engines may utilize recirculation of exhaust gas from an engine exhaust system to an engine intake system, a process referred to as exhaust gas recirculation (EGR). In some examples, a group of one or more cylinders may have an exhaust manifold that is coupled to an intake passage of the engine such that the group of cylinders is dedicated, at least under some conditions, to generating exhaust gas for EGR. Such cylinders may be referred to as "donor cylinders." In other systems, the exhaust gas may be pulled from a manifold.

Some EGR systems may include an EGR cooler to reduce a temperature of the recirculated exhaust gas before it enters the intake passage. The exhaust gas recirculation (EGR) cooler may be used to reduce exhaust gas temperature from about 1000 degrees Fahrenheit to about 200 degrees Fahrenheit. In such an example, fouling of the EGR cooler may occur when particulate matter (e.g., soot, hydrocarbons, oil, fuel, rust, ash, mineral deposits, and the like) in the exhaust gas accumulates within the EGR cooler. The EGR cooler can foul over time due to various factors (duty cycle, time at idle, engine oil carryover, time in service) decreasing effectiveness of the EGR cooler and increasing a pressure drop across the EGR cooler as well as temperature of the gas exiting the cooler. This could result in increased level of emissions and decreased fuel efficiency.

Some EGR coolers may fail during use due to high stress concentration in tubes at a leading edge of the heat exchanger—the edge that is closest to a tube sheet. The proximity would sometimes subject portions of the system to high stress due to low water flow, over constraint by a heat exchanger sidewall, and high thermal gradients.

If fouling occurs, the engine system switches into a cleaning mode referred to as port heating. Port heating is an operating mode that reduces an amount of (i.e. oxidizes and/or vaporizes) liquid oil that may be present (fouling) an exhaust system. In one example, during the port heating mode the system over-fuels individual cylinder(s) during engine idle. This over-fueling continues and heats the local exhaust port. The system engages port heating periodically at low loads, such as idle and/or in response to the engine experiencing conditions that put engine at risk for oil in the exhaust system. Fouling, or "souping," can cause unburned oil to foul engine hardware such as the EGR cooler. If this unburned oil is blown out the exhaust stack, it may leave an unsightly residue on the exterior of the equipment and/or vehicle. Thus, port heating has been used to reduce oil residue fouling of the EGR cooler, engine intake, and equipment exterior.

It may be desirable to have an EGR cooler system that prevents fouling, or if fouled is easier to clean, than those systems that are currently available.

BRIEF DESCRIPTION

In an embodiment, an exhaust gas recirculation cooler is provided that includes an exhaust gas inlet and an exhaust gas outlet spaced from the exhaust gas inlet; a plurality of cooling tubes disposed between the exhaust gas inlet and exhaust gas outlet; and a baffle positioned proximate to the exhaust gas inlet and interposed between the plurality of cooling tubes and the exhaust gas inlet. The baffle is configured to direct exhaust gas entering the EGR cooler through the exhaust gas inlet to the plurality of cooling tubes in a defined path.

In an embodiment, a system is provided that includes a controller that can respond to a signal that indicates a determined level of fouling in an EGR cooler. Based on a trigger condition as determined by the controller, e.g., if the level of fouling is above a designated threshold, the controller is configured to initiate an EGR cooler cleaning mode of operation.

DETAILED DESCRIPTION

Figure 1:
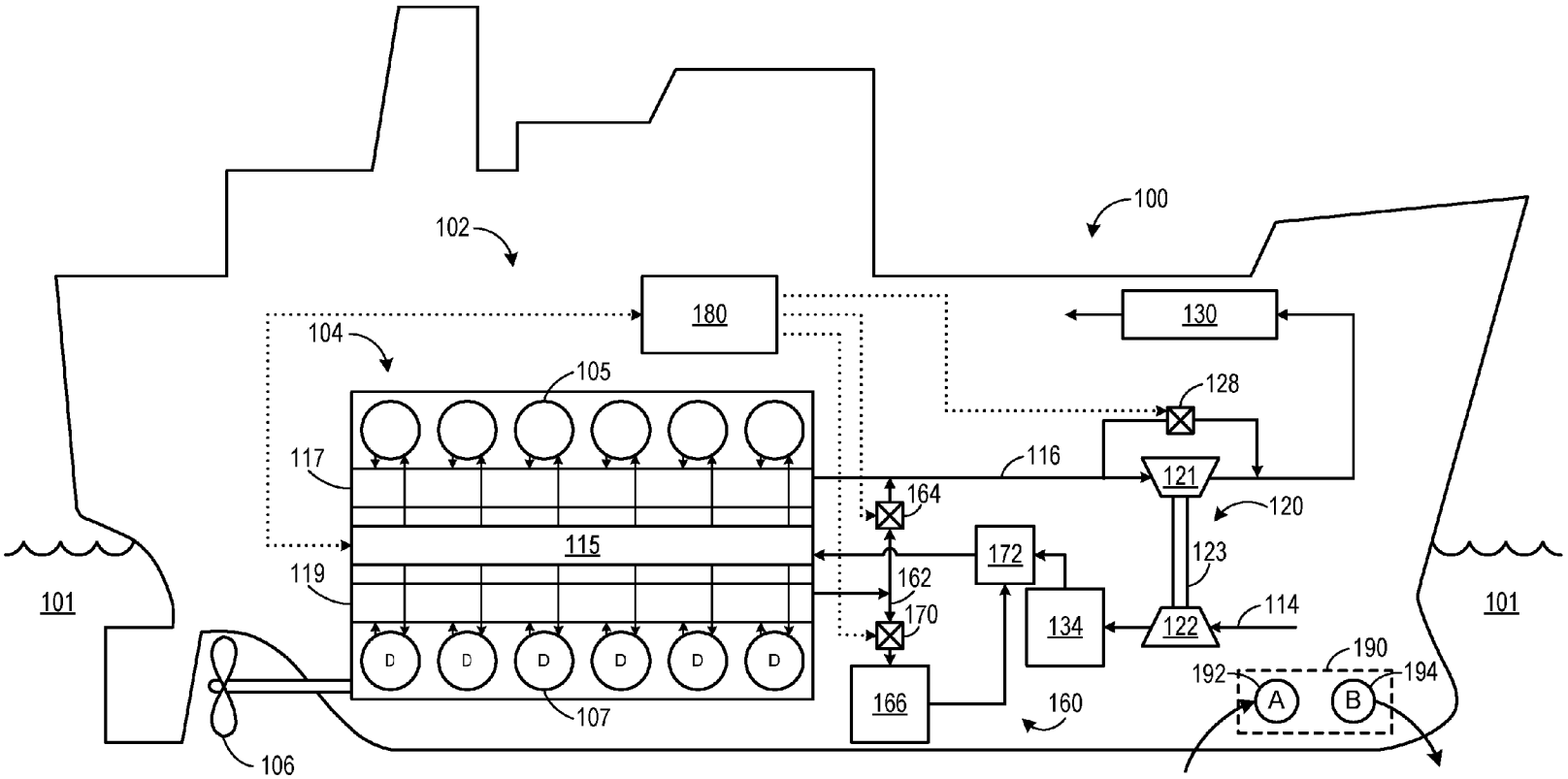
FIG. 1 shows a schematic diagram of an engine with an exhaust gas recirculation (EGR) system in a marine vessel according to an embodiment of the invention.
Figure 2:
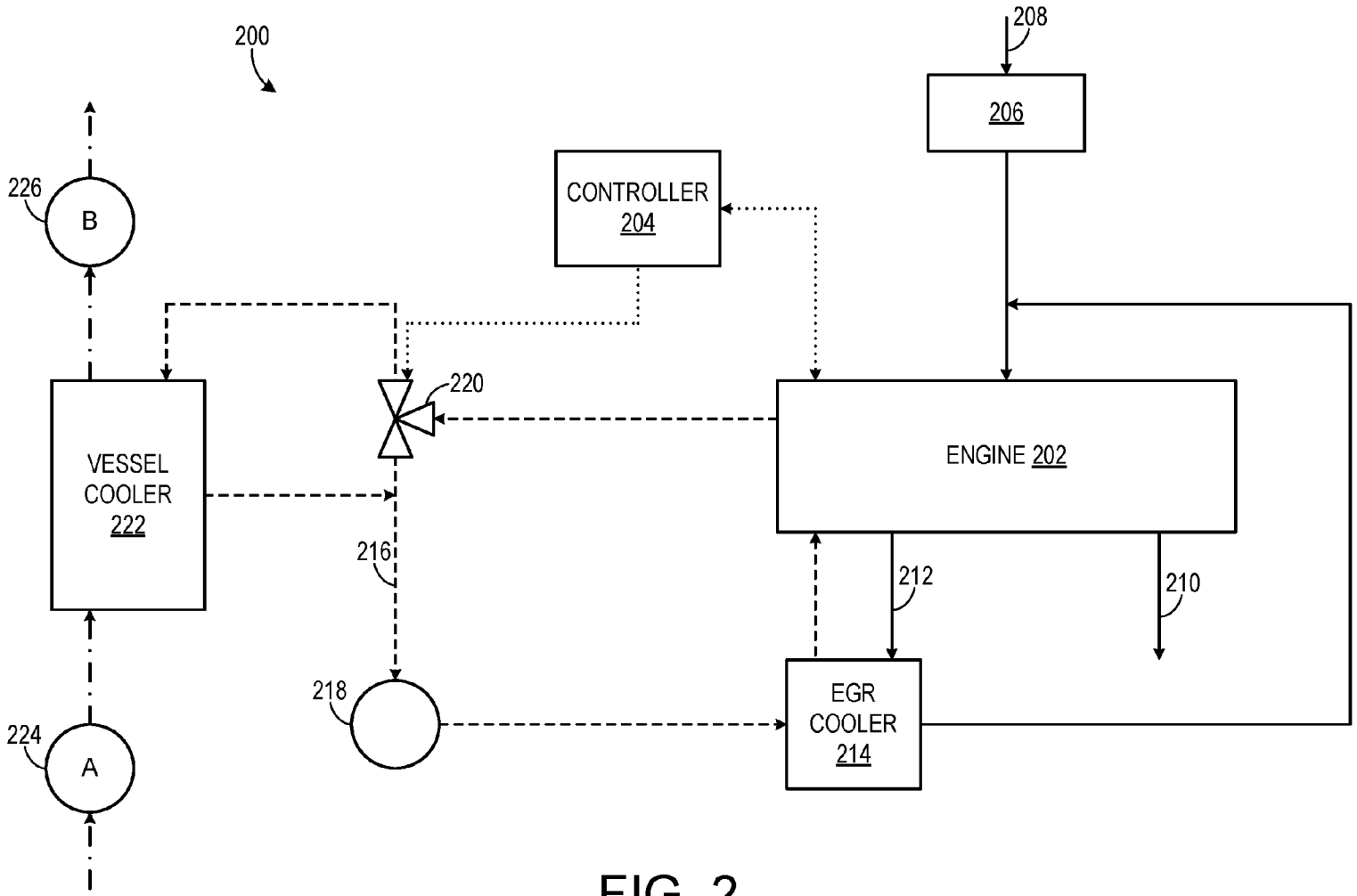
FIG. 2 shows a schematic diagram of a cooling fluid circuit which includes an engine and an EGR cooler according to an embodiment of the invention.
Figure 4:
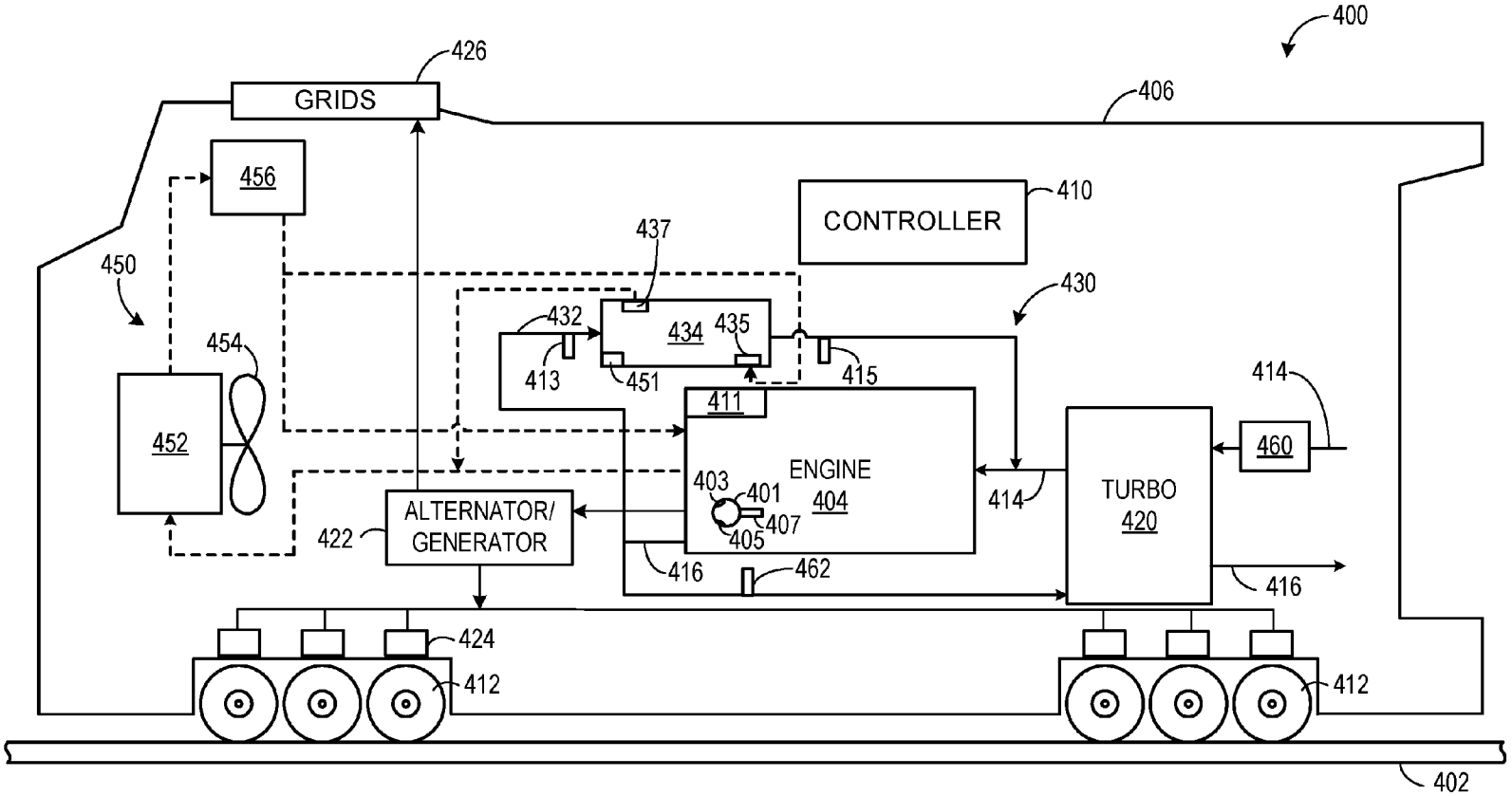
FIG. 4 shows a schematic diagram of a rail vehicle with an engine and EGR cooler according to an embodiment of the invention.
Figure 8:
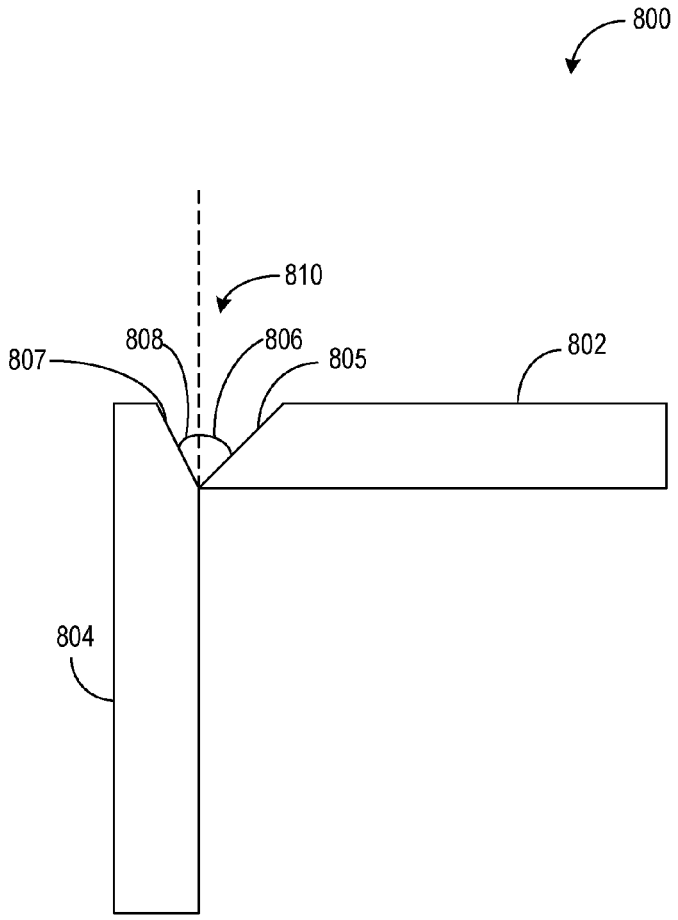
FIG. 8 shows a schematic of an arrangement of a tube sheet and sidewall of an EGR cooler housing according to an embodiment of the invention.
Figure 9:
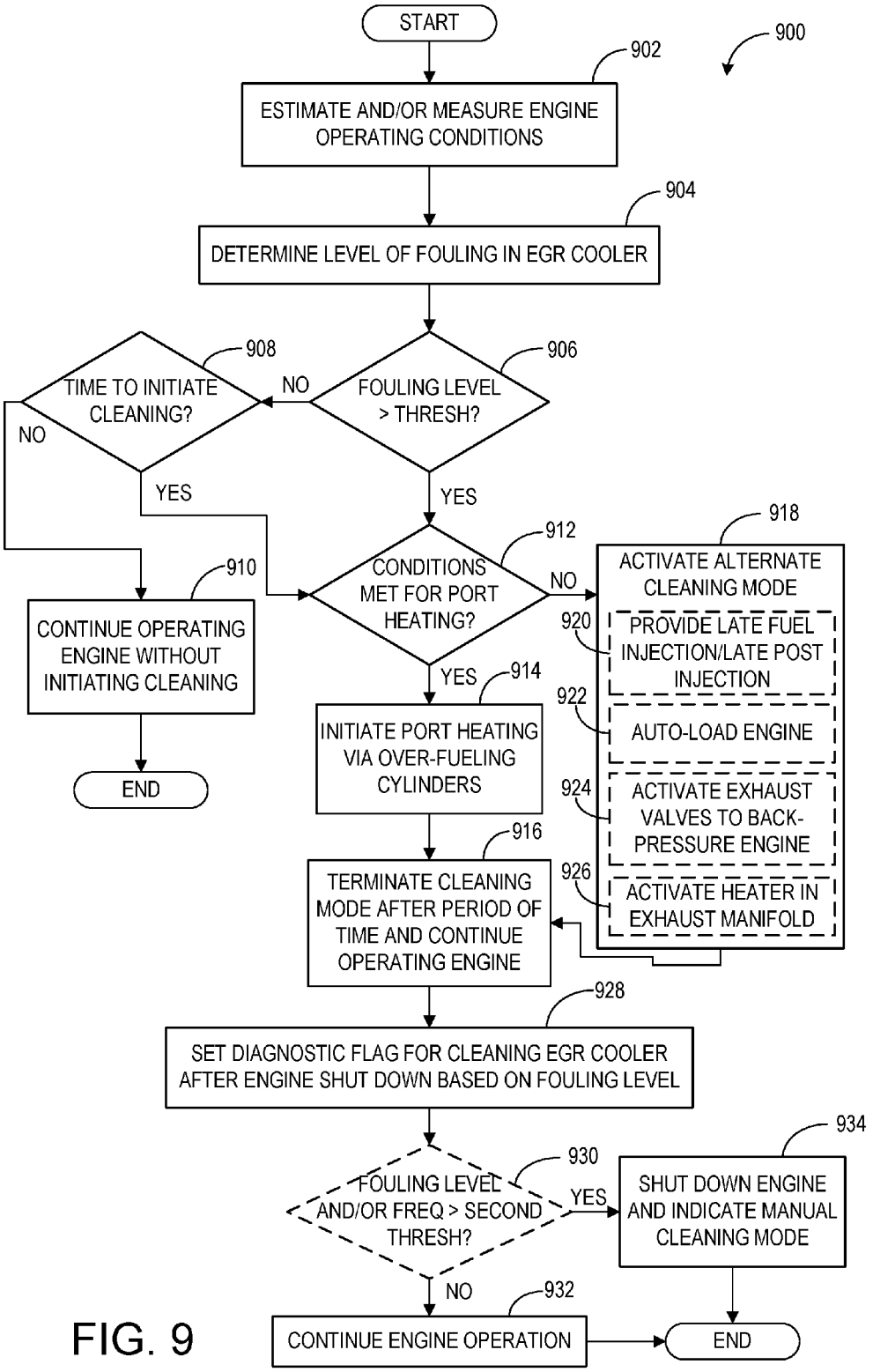
FIG. 9 shows a flow chart of a method for initiating a cleaning mode of an EGR cooler according to an embodiment of the invention.

One or more embodiments of the inventive subject matter described herein are directed to a system that includes exhaust gas recirculation (EGR), and an EGR cooler as part of that system, such as the engine systems shown in FIGS. 1-2 and 4. An engine generates exhaust and a portion of that exhaust is directed to an air intake for the engine, prior to mixing the exhaust gas with the intake air, the exhaust gas is cooled in the EGR cooler. Embodiments of the EGR cooler are shown in FIGS. 5-8. Over time, the EGR cooler may foul, thereby increasing the gas flow resistance through the EGR cooler and decreasing the effectiveness in cooling exhaust gases of the EGR cooler. Thus, in some embodiments, as shown in FIG. 9, an engine controller may execute various cleaning routines (e.g., cleaning modes) for reducing deposits within the EGR cooler while the engine is running. Further, when the engine is not being operated, the EGR cooler may be cleaned via a cleaning system (such as the system shown in FIG. 10) via a cleaning protocol, as outlined by the method presented in FIG. 11. In this way, the EGR cooler may be cleaned to increase the effectiveness of the EGR cooler.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

FIG. 1 shows a block diagram of an exemplary embodiment of a system, herein depicted as a marine vessel 100, such as a ship, configured to operate in a body of water 101. The marine vessel 100 includes an engine system 102, such as a propulsion system, with an engine 104. However, in other examples, engine 104 may be a stationary engine, such as in a power-plant application, or an engine in a rail vehicle propulsion system. In the exemplary embodiment of FIG. 1, a propeller 106 is mechanically coupled to the engine 104 such that it is turned by the engine 104. In other examples, the engine system 102 may include a generator that is driven by the engine, which in turn drives a motor that turns the propeller, for example.

The engine 104 receives intake air for combustion from an intake, such as an intake manifold 115. The intake may be any suitable conduit or conduits through which gases flow to enter the engine. For example, the intake may include the intake manifold 115, an intake passage 114, and the like. The intake passage 114 receives ambient air from an air filter (not shown) that filters air from outside of the vehicle in which the engine 104 is positioned. Exhaust gas resulting from combustion in the engine 104 is supplied to an exhaust, such as exhaust passage 116. The exhaust may be any suitable conduit through which gases flow from the engine. For example, the exhaust may include an exhaust manifold 117, the exhaust passage 116, and the like. Exhaust gas flows through the exhaust passage 116.

In the exemplary embodiment depicted in FIG. 1, the engine 104 is a V-12 engine having twelve cylinders. In other examples, the engine may be a V-6, V-8, V-10, V-16, I-4, I-6, I-8, opposed 4, or another engine type. As depicted, the engine 104 includes a subset of non-donor cylinders 105, which includes six cylinders that supply exhaust gas exclusively to a non-donor cylinder exhaust manifold 117, and a subset of donor cylinders 107, which includes six cylinders that supply exhaust gas exclusively to a donor cylinder exhaust manifold 119. In other embodiments, the engine may include at least one donor cylinder and at least one non-donor cylinder. For example, the engine may have four donor cylinders and eight non-donor cylinders, or three donor cylinders and nine non-donor cylinders. It should be understood, the engine may have any desired numbers of donor cylinders and non-donor cylinders, with the number of donor cylinders typically lower than the number of non-donor cylinders.

As depicted in FIG. 1, the non-donor cylinders 105 are coupled to the exhaust passage 116 to route exhaust gas from the engine to atmosphere (after it passes through an exhaust gas treatment system 130 and a turbocharger 120). The donor cylinders 107, which provide engine exhaust gas recirculation (EGR), are coupled exclusively to an EGR passage 162 of an EGR system 160 which routes exhaust gas from the donor cylinders 107 to the intake passage 114 of the engine 104, and not to atmosphere. By introducing cooled exhaust gas to the engine 104, the amount of available oxygen for combustion is decreased, thereby reducing combustion flame temperatures and reducing the formation of nitrogen oxides (e.g., NOR).

In the exemplary embodiment shown in FIG. 1, when a second valve 170 is open, exhaust gas flowing from the donor cylinders 107 to the intake passage 114 passes through a heat exchanger such as an EGR cooler 166 to reduce a temperature of (e.g., cool) the exhaust gas before the exhaust gas returns to the intake passage. The EGR cooler 166 may be an air-to-liquid heat exchanger, for example. In such an example, one or more charge air coolers 134 disposed in the intake passage 114 (e.g., upstream of an EGR inlet where the recirculated exhaust gas enters) may be adjusted to further increase cooling of the charge air such that a mixture temperature of charge air and exhaust gas is maintained at a desired temperature. In other examples, the EGR system 160 may include an EGR cooler bypass.

Further, the EGR system 160 includes a first valve 164 disposed between the exhaust passage 116 and the EGR passage 162. The second valve 170 may be an on/off valve controlled by the controller 180 (for turning the flow of EGR on or off), or it may control a variable amount of EGR, for example. In some examples, the first valve 164 may be actuated such that an EGR amount is reduced (exhaust gas flows from the EGR passage 162 to the exhaust passage 116). In other examples, the first valve 164 may be actuated such that the EGR amount is increased (e.g., exhaust gas flows from the exhaust passage 116 to the EGR passage 162). In some embodiments, the EGR system 160 may include a plurality of EGR valves or other flow control elements to control the amount of EGR.

As shown in FIG. 1, the engine system 102 further includes an EGR mixer 172 which mixes the recirculated exhaust gas with charge air such that the exhaust gas may be evenly distributed within the charge air and exhaust gas mixture. In the exemplary embodiment depicted in FIG. 1, the EGR system 160 is a high-pressure EGR system which routes exhaust gas from a location upstream of a turbine of the turbocharger 120 in the exhaust passage 116 to a location downstream of a compressor of the turbocharger 120 in the intake passage 114. In other embodiments, the engine system 100 may additionally or alternatively include a low-pressure EGR system which routes exhaust gas from downstream of the turbocharger 120 in the exhaust passage 116 to a location upstream of the turbocharger 120 in the intake passage 114. It should be understood, the high-pressure EGR system provides relatively higher pressure exhaust gas to the intake passage 114 than the low-pressure EGR system, as the exhaust gas delivered to the intake manifold 114 in the high pressure EGR system has not passed through a turbine 121 of the turbocharger 120.

In the exemplary embodiment of FIG. 1, the turbocharger 120 is arranged between the intake passage 114 and the exhaust passage 116. The turbocharger 120 increases air charge of ambient air drawn into the intake passage 114 in order to provide greater charge density during combustion to increase power output and/or engine-operating efficiency. The turbocharger 120 includes a compressor 122 arranged along the intake passage 114. The compressor 122 is at least partially driven by the turbine 121 (e.g., through a shaft 123) that is arranged in the exhaust passage 116. While in this case a single turbocharger is shown, the system may include multiple turbine and/or compressor stages. In the example shown in FIG. 1, the turbocharger 120 is provided with a wastegate 128 which allows exhaust gas to bypass the turbocharger 120. The wastegate 128 may be opened, for example, to divert the exhaust gas flow away from the turbine 121. In this manner, the rotating speed of the compressor 122, and thus the boost provided by the turbocharger 120 to the engine 104, may be regulated during steady state conditions.

The engine system 100 further includes an exhaust treatment system 130 coupled in the exhaust passage in order to reduce regulated emissions. As depicted in FIG. 1, the exhaust gas treatment system 130 is disposed downstream of the turbine 121 of the turbocharger 120. In other embodiments, an exhaust gas treatment system may be additionally or alternatively disposed upstream of the turbocharger 120. The exhaust gas treatment system 130 may include one or more components. For example, the exhaust gas treatment system 130 may include one or more of a diesel particulate filter (DPF), a diesel oxidation catalyst (DOC), a selective catalytic reduction (SCR) catalyst, a three-way catalyst, a $NO_x$ trap, and/or various other emission control devices or combinations thereof.

The engine system 100 further includes the controller 180, which is provided and configured to control various components related to the engine system 100. In one example, the controller 180 includes a computer control system. The controller 180 further includes non-transitory, computer readable storage media (not shown) including code for enabling on-board monitoring and control of engine operation. The controller 180, while overseeing control and management of the engine system 102, may be configured to receive signals from a variety of engine sensors, as further elaborated herein, in order to determine operating parameters and operating conditions, and correspondingly adjust various engine actuators to control operation of the engine system 102. For example, the controller 180 may receive signals from various engine sensors including, but not limited to, engine speed, engine load, boost pressure, ambient pressure, exhaust temperature, exhaust pressure, etc. Correspondingly, the controller 180 may control the engine system 102 by sending commands to various components such as an alternator, cylinder valves, throttle, heat exchangers, wastegates or other valves or flow control elements, etc.

As another example, the controller 180 may receive signals from various temperature sensors and pressure sensors disposed in various locations throughout the engine system. In other examples, the first valve 164 and the second valve 170 may be adjusted to adjust an amount of exhaust gas flowing through the EGR cooler to control the manifold air temperature or to route a desired amount of exhaust to the intake manifold for EGR. As another example, the controller 180 may receive signals from temperature and/or pressure sensor indicating temperature and/or pressure of cooling fluid at various locations in a cooling fluid circuit, such as the cooling fluid circuit 216 described below with reference to FIG. 2. For example, the controller may control a cooling fluid flow through a thermostat based on an engine out cooling fluid temperature.

The marine vessel 100 further includes a bilge system 190, which, at least in part, removes water from a hull of the marine vessel 100. The bilge system 190 may include pumps, motors to run the pumps, and a control system. For example, the controller 180 may be in communication with the bilge system 190. As depicted in FIG. 1, the bilge system includes a first pump "A" 192 which draws ambient marine water from the body of water 101 onto the marine vessel. The ambient marine water may have a lower temperature than a temperature of air surrounding the marine vessel 100. Thus, the ambient marine water may provide increased cooling to a cooling fluid circuit, as will be described in greater detail below with reference to FIG. 2. The bilge system further includes a pump "B" 194 which pumps water from the marine vessel 100 into the body of water 101. The bilge system 190 may include a filtration system (not shown), for example, to remove contaminants from the water before it is pumped into the body of water 101.

FIG. 2 shows a system 200 with an engine 202, such as the engine 104 described above with reference to FIG. 1. As depicted, air (indicated by a solid line in FIG. 2) flows through a charge air cooler 206, such as an intercooler before entering the engine 202 via an intake passage 208. As an example, the intake air may have a temperature of approximately 43° C. after passing through the charge air cooler 206. Some exhaust gas exhausted from the engine 202 is exhausted via an exhaust passage 210. For example, as described above, exhaust gas exhausted via the exhaust passage 210 may be from non-donor cylinders of the engine 202. Exhaust gas may be exhausted via the exhaust passage 212 for exhaust gas recirculation, for example. The exhaust gas exhausted via the exhaust passage 212 may be from donor cylinders of the engine 202, as described above. As an example, exhaust gas exhausted from the engine via either the donor cylinders or the non-donor cylinders may have a temperature of approximately 593° C.

The exhaust gas directed along the exhaust passage 212 flows through an EGR cooler 214 before it enters the intake passage 208 of the engine 202. The EGR cooler 214 may be a gas-to-liquid heat exchanger, for example, which cools the exhaust gas by transferring heat to a cooling fluid, such as a liquid cooling fluid. After passing through the EGR cooler, the temperature of the exhaust gas may be reduced to approximately 110° C., for example. Once the exhaust gas enters the intake passage 208 and mixes with the cooled intake air, the temperature of the charge air may be approximately 65° C. The temperature of the charge air may vary depending on the amount of EGR and the amount of cooling carried out by the charge air cooler 206 and the EGR cooler 214, for example.

As depicted in FIG. 2, the system 200 further includes a cooling fluid circuit 216. The cooling fluid circuit 216 directs cooling fluid (indicated by a dashed line in FIG. 2) through the EGR cooler 214 and the engine 202 to cool the EGR cooler 214 and the engine 202. The cooling fluid flowing through the cooling fluid circuit 216 may be engine oil or water, for example, or another suitable fluid. In the cooling fluid circuit 216 shown in the exemplary embodiment of FIG. 2, a pump 218 is disposed upstream of the EGR cooler 214. In such a configuration, the pump 218 may supply cooling fluid to the EGR cooler 214 at a desired pressure. As an example, the pressure of cooling fluid may be determined based on a boiling point of the cooling fluid and an increase in temperature of the cooling fluid that occurs due to heat exchange with exhaust gas in the EGR cooler 214 and heat exchange with the engine 202. In one example, a pressure of the cooling fluid exiting the pump 218 may be approximately 262,001 Pa (38 psi), have a flow rate of approximately 1703 liters per minute (450 gallons per minute), and have a temperature of approximately 68° C. By supplying the EGR cooler 214 with cooling fluid pressurized by the pump 218, boiling of the cooling fluid may be reduced. Further, as the cooling fluid is pressurized by the pump 218, the need for a pressure cap in the system is reduced and degradation of various components, such as the engine 202 and EGR cooler 214, due to degradation of the pressure cap may be reduced. In some embodiments, the pump 218 may be mechanically coupled to a crankshaft of the engine to rotate with the crankshaft, such that the pump 218 is driven by the crankshaft. In other embodiments, the pump 218 may be an electrically driven pump which is driven by an alternator of the engine system, for example.

In the exemplary embodiment shown in FIG. 2, the cooling fluid circuit cools the EGR cooler 214 of a high-pressure EGR system, such as the high-pressure EGR system 160 described above with reference to FIG. 1. In other embodiments, the cooling fluid circuit may additionally or alternatively provide cooling to an EGR cooler of a low-pressure EGR system.

As shown, cooling fluid flows from the pump 218 to the EGR cooler 214. Exhaust gas passing through the EGR cooler 214 transfers heat to the cooling fluid such that the exhaust gas is cooled before it enters the intake passage 208 of the engine 202. In the exemplary embodiment shown in FIG. 2, the EGR cooler 214 and the engine 202 are positioned in series. Thus, after cooling exhaust gas in the EGR cooler 214, the cooling fluid exits the EGR cooler 214 and enters the engine 202 where it cools the engine. Because the engine 202 is disposed downstream of the EGR cooler 214, the cooling fluid entering the engine 202 has a higher temperature than the cooling fluid entering the EGR cooler 214. As an example, the temperature of the cooling fluid exiting the EGR cooler 214 may have a temperature of approximately 84° C., which may vary depending on the cooling fluid temperature before it enters the EGR cooler 214, an amount of EGR passing through the EGR cooler 214, and the like. In this way, the engine may be maintained at a higher temperature, as the cooling fluid temperature is higher and less cooling occurs. As such, thermal efficiency of the engine may be increased.

The system 200 further includes a thermostat 220 positioned in the cooling fluid circuit downstream of the engine. The thermostat 220 may be adjusted to maintain an engine out temperature of the cooling fluid (e.g., the temperature of the cooling fluid as it exits the engine), for example. In some examples, the thermostat 220 may be an electronic thermostatic valve; while in other examples, the thermostat 220 may be a mechanical thermostatic valve. In some embodiments, a control system which includes a controller 204, such as the controller 180 described above with reference to FIG. 1, may control a position of the thermostat 220 based on the engine out cooling fluid temperature. As an example, the engine out cooling fluid temperature may be approximately 93° C. As one example, the thermostat may be adjusted such that no cooling fluid leaves the engine (e.g., the cooling fluid is stagnant in the engine), such as during engine warm-up, for example. As another example, the thermostat 220 may be adjusted to direct cooling fluid warmed by the engine 202 to the EGR cooler 214 without being cooled by a vessel cooler 222. In such an example, the warmed cooling fluid may mix with cooling fluid cooled by the vessel cooler 222 such that a temperature of the cooling fluid entering the EGR cooler 214 is relatively warmer. In this manner, thermal efficiency of the engine 202 may be maintained when there is a relatively small amount of exhaust gas recirculation, for example, and less heat transferred to the cooling fluid by the EGR cooler 214. As yet another example, the thermostat 220 may be adjusted such that substantially all of the cooling fluid exiting the engine 202 is directed to the vessel cooler 222. In this manner, the thermostat 222 is operable to maintain an engine out cooling out cooling fluid temperature.

The vessel cooler 222 may be a liquid-to-liquid heat exchanger, for example. As depicted in FIG. 2, cooling fluid from the engine 202 passes through the heat exchanger before it is directed to the pump 218. Cooling fluid passing through the vessel cooler 222 is cooled via heat transfer to ambient marine water (e.g., water from the body of water in which the marine vessel is positioned). For example, the vessel cooler may be fluidly coupled to a bilge system of the marine vessel, such as the bilge system 190 described above with reference to FIG. 1. In such a configuration, a pump A 224 may draw ambient marine water from external to the marine vessel (indicated by a dashed and dotted line in FIG. 2) and through the vessel cooler 222. Marine water warmed via heat exchange with the cooling fluid leaves the vessel cooler 222 and is exhausted out of the marine vessel via a pump B 226, for example. The ambient marine water may have a lower temperature than a temperature of air surrounding the marine vessel; as such, a greater heat exchange may occur between the cooling fluid and the marine water. Further, even greater cooling of the cooling fluid occurs, as the vessel cooler 222 is a liquid-to-liquid heat exchanger and a liquid-to-liquid heat exchanger provides a higher heat transfer rate than a liquid-to-air heat exchanger. Further still, because there is a large volume of the marine water and cooling of the marine water is not needed, it is possible to maintain a low temperature of the cooling fluid. In other embodiments, however, the vessel cooler may be a liquid-to-air heat exchanger, such as in a locomotive, off-highway vehicle, or stationary embodiment.

Thus, due to the relatively low temperature of the ambient marine water and the liquid-to-liquid heat transfer, the marine water may provide increased cooling of the cooling fluid as compared to air-based cooling systems. As such, a smaller EGR cooler may be used, thereby reducing a size and cost of the cooling system, for example. Further, because the EGR cooler 214 is positioned in series with the engine 202, an amount of cooling fluid flowing through the cooling fluid circuit may be reduced. For example, when the EGR cooler and engine are positioned in parallel, a greater amount of cooling fluid is needed to supply the EGR cooler and engine with similar flows of cooling fluid.

Figure 3:
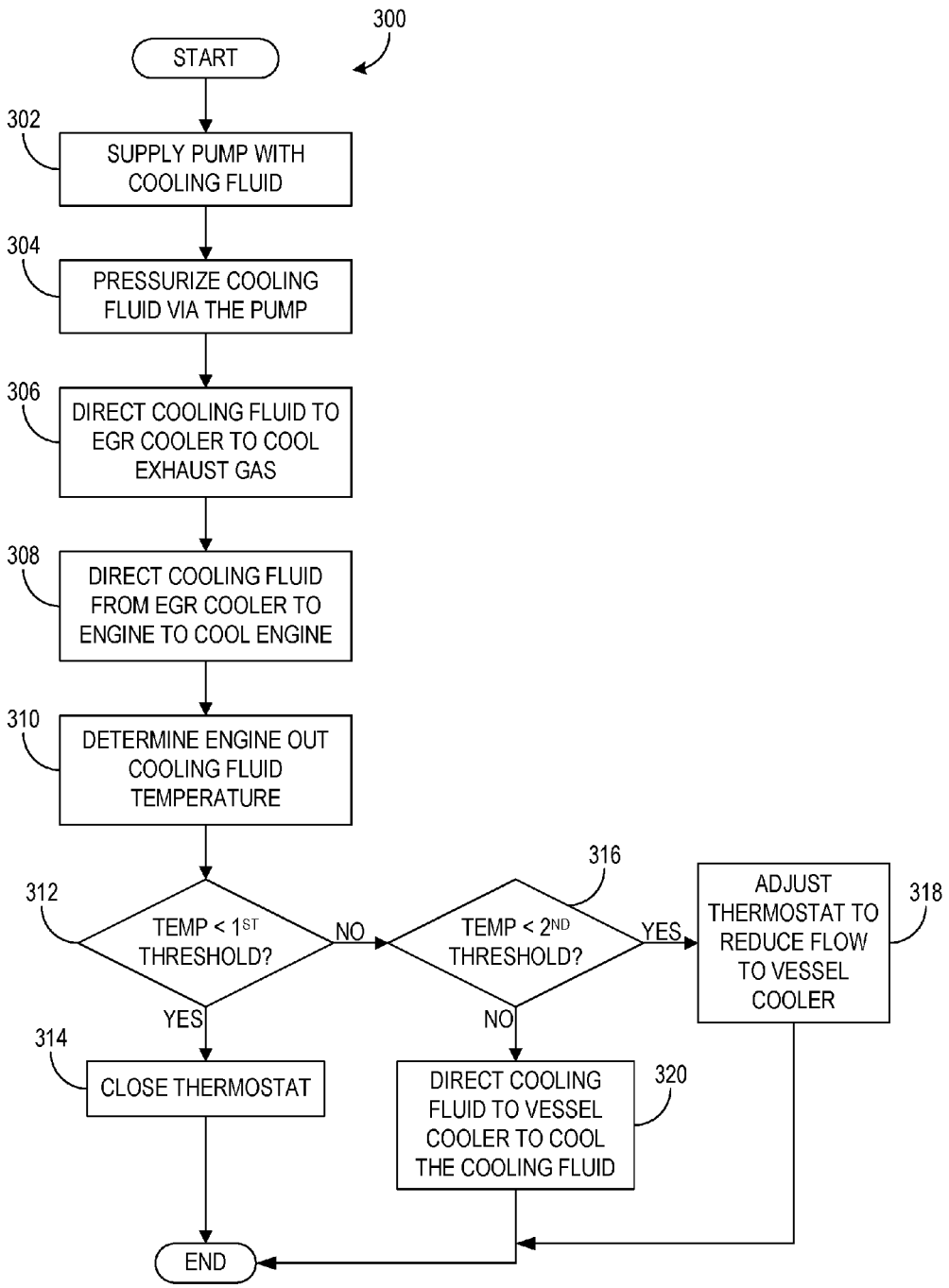
FIG. 3 shows a flow chart illustrating a method for a cooling fluid circuit according to an embodiment of the invention.

An embodiment relates to a method (e.g., a method for a cooling fluid circuit). The method comprises pressurizing a cooling fluid with a pump, and directing the cooling fluid pressurized by the pump to an exhaust gas recirculation cooler, to cool recirculated exhaust gas from an engine. The method further comprises cooling the engine by directing cooling fluid exiting the exhaust gas recirculation cooler to the engine before returning it to the pump. An example of another embodiment of a method (for a cooling fluid circuit) is illustrated in the flow chart of, FIG. 3. Specifically, the method 300 directs cooling fluid through a cooling fluid circuit positioned in a marine vessel, such as the cooling fluid circuit 216 described above with reference to FIG. 2.

At step 302 of the method, a pump is supplied with cooling fluid. The cooling fluid may be cooled cooling fluid from a vessel cooler, for example. In some examples, the cooled cooling fluid from the vessel cooler may be mixed with cooling fluid exiting an engine such that a temperature of the cooling fluid is increased.

At step 304, the cooling fluid is pressurized via the pump. The output pressure of the pump may be based on a boiling point of the cooling fluid and an expected amount of heat transfer to the cooling fluid by an EGR cooler and/or the engine. For example, the cooling fluid may be pressurized so that the cooling fluid does not exceed its boiling point.

The pressurized cooling fluid is directed from the pump to the EGR cooler at step 306 to cool exhaust gas passing through the EGR cooler for exhaust gas recirculation. For example, heat is transferred from the exhaust gas to the cooling fluid such that the exhaust gas is cooled and the cooling fluid is warmed. At step 308, cooling fluid exiting the EGR cooler is directed to the engine, which is positioned in series with the EGR cooler, to cool the engine. For example, heat is transferred from various components of the engine to the cooling fluid such that a temperature of the cooling fluid increases and the engine is cooled.

At step 310, an engine out temperature of the cooling fluid is determined. As an example, the cooling fluid circuit may include a temperature sensor at an engine cooling fluid outlet. As another example, the temperature of the cooling fluid may be determined at a thermostat.

At step 312, it is determined if the engine out cooling fluid temperature is less than a first threshold temperature. If it is determined that the cooling fluid temperature is less than the first threshold temperature, the method continues to step 314 where the thermostat is closed such that the cooling fluid flow through the engine is reduced. On the other hand, if the engine out cooling fluid temperature is greater than the first threshold temperature, the method moves to step 316 where it is determined if the temperature is less than a second threshold temperature, where the second threshold temperature is greater than the first threshold temperature.

If it is determined that the engine out cooling fluid temperature is less than the second threshold temperature, the method proceeds to step 318 where the thermostat is adjusted such that at least a portion of the cooling fluid bypasses the vessel cooler. In this manner, a temperature of the engine may be maintained at a higher temperature to maintain engine efficiency, for example, even when an amount of EGR is reduced resulting in reduced heat transfer to the cooling fluid from exhaust gas in the EGR cooler. In contrast, if it is determined that the engine out cooling fluid temperature is greater than the second threshold temperature, the method moves to step 320 where all of the cooling fluid is directed to the vessel cooler.

Thus, by positioning the EGR cooler and the engine in series in a cooling fluid circuit, an amount of cooling fluid flowing through the cooling fluid circuit may be reduced, as the cooling fluid flows through the EGR cooler and then the engine. Because the cooling fluid is warmed by the EGR cooler before it enters the engine, less heat exchange may occur in the engine resulting in a higher engine operating temperature and greater thermal efficiency of the engine. Further, because the cooling fluid is pressurized by the pump before it enters the EGR cooler, a possibility of boiling cooling fluid may be reduced.

Another embodiment relates to a system, e.g., a system for a marine vessel or other vehicle. The system comprises a reservoir for holding a cooling fluid, an exhaust gas recirculation cooler, an engine, and a cooling fluid circuit. (The reservoir may be a tank, but could also be a return line or other conduit, that is, the reservoir does not necessarily have to hold a large volume of cooling fluid. The reservoir is generally shown as pointed at by 216 in FIG. 2.) The cooling fluid circuit interconnects the reservoir, the exhaust gas recirculation cooler, and the engine. The cooling fluid circuit is configured to direct the cooling fluid in series from the reservoir, to the exhaust gas recirculation cooler, to the engine, and back to the reservoir. For example, in operation, the cooling fluid travels, in order from upstream to downstream: through a first conduit of the cooling fluid circuit from an outlet of the reservoir to an inlet of the exhaust gas recirculation cooler; through the exhaust gas recirculation cooler; through a second conduit of the cooling fluid circuit from an outlet of the exhaust gas recirculation cooler to an inlet of a cooling system (e.g., cooling jacket) of the engine; through the cooling system of the engine; and through a third conduit of the cooling fluid circuit from an outlet of the engine cooling system to an inlet of the reservoir. In another embodiment, the system further comprises a pump operably coupled with the reservoir and the cooling fluid circuit; the pump is configured to pressurize the cooling fluid that is directed through the cooling fluid circuit.

Another embodiment relates to a system, e.g., a system for a marine vessel or other vehicle. The system comprises a pump, an exhaust gas recirculation cooler, an engine, and a cooling fluid circuit. The cooling fluid circuit interconnects the pump, the exhaust gas recirculation cooler, and the engine. The cooling fluid circuit is configured to direct cooling fluid pressurized by the pump in series from the pump, to the exhaust gas recirculation cooler, to the engine, and back to the pump (or back to a return line or other reservoir to which the pump is operably coupled for receiving cooling fluid). For example, in operation, the cooling fluid pressurized by the pump travels, in order from upstream to downstream: through a first conduit of the cooling fluid circuit from an outlet of the pump to an inlet of the exhaust gas recirculation cooler; through the exhaust gas recirculation cooler; through a second conduit of the cooling fluid circuit from an outlet of the exhaust gas recirculation cooler to an inlet of a cooling system (e.g., cooling jacket) of the engine; through the cooling system of the engine; and through a third conduit of the cooling fluid circuit from an outlet of the engine cooling system to an inlet of the pump (or reservoir).

FIG. 4 shows another embodiment of a system in which an EGR cooler may be installed. Specifically, FIG. 4 shows a block diagram of an embodiment of a vehicle system 400, herein depicted as a rail vehicle 406 (e.g., locomotive), configured to run on a rail 402 via a plurality of wheels 412. As depicted, the rail vehicle includes an engine 404. The engine shown in FIG. 4 may include similar components as the engine shown in FIG. 1. Additionally, as shown in FIG. 4, the engine includes a plurality of cylinders 401 (only one representative cylinder shown in FIG. 4) that each include at least one intake valve 403, exhaust valve 405, and fuel injector 407. Each intake valve, exhaust valve, and fuel injector may include an actuator that is actuatable via a signal from a controller 410 of the engine. In other non-limiting embodiments, the engine may be a stationary engine, such as in a power-plant application, or an engine in a marine vessel or other off-highway vehicle propulsion system as noted above.

The engine receives intake air for combustion from an intake passage 414. The intake passage receives ambient air from an air filter 460 that filters air from outside of the rail vehicle. Exhaust gas resulting from combustion in the engine is supplied to an exhaust passage 416. Exhaust gas flows through the exhaust passage, and out of an exhaust stack of the rail vehicle. In one example, the engine is a diesel engine that combusts air and diesel fuel through compression ignition. In another example, the engine is a dual or multi-fuel engine that may combust a mixture of gaseous fuel and air upon injection of diesel fuel during compression of the air-gaseous fuel mix. In other non-limiting embodiments, the engine may additionally combust fuel including gasoline, kerosene, natural gas, biodiesel, or other petroleum distillates of similar density through compression ignition (and/or spark ignition).

In one embodiment, the rail vehicle is a diesel-electric vehicle. As depicted in FIG. 4, the engine is coupled to an electric power generation system, which includes an alternator/generator 422 and electric traction motors 424. For example, the engine is a diesel and/or natural gas engine that generates a torque output that is transmitted to the alternator/generator which is mechanically coupled to the engine. In one embodiment herein, the engine is a multi-fuel engine operating with diesel fuel and natural gas, but in other examples the engine may use various combinations of fuels other than diesel and natural gas.

The alternator/generator produces electrical power that may be stored and applied for subsequent propagation to a variety of downstream electrical components. As an example, the alternator/generator may be electrically coupled to a plurality of traction motors and the alternator/generator may provide electrical power to the plurality of traction motors. As depicted, the plurality of traction motors are each connected to one of the plurality of wheels to provide tractive power to propel the rail vehicle. One example configuration includes one traction motor per wheel set. As depicted herein, six traction motors correspond to each of six pairs of motive wheels of the rail vehicle. In another example, alternator/generator may be coupled to one or more resistive grids 426. The resistive grids may be configured to dissipate excess engine torque via heat produced by the grids from electricity generated by alternator/generator.

In some embodiments, the vehicle system may include a turbocharger 420 that is arranged between the intake passage and the exhaust passage. The turbocharger increases air charge of ambient air drawn into the intake passage in order to provide greater charge density during combustion to increase power output and/or engine-operating efficiency. The turbocharger may include a compressor (not shown) which is at least partially driven by a turbine (not shown). While in this case a single turbocharger is included, the system may include multiple turbine and/or compressor stages. Additionally or alternatively, in some embodiments, a supercharger may be present to compress the intake air via a compressor driven by a motor or the engine, for example. Further, in some embodiments, a charge air cooler (e.g., water-based intercooler) may be present between the compressor of the turbocharger or supercharger and intake manifold of the engine. The charge air cooler may cool the compressed air to further increase the density of the charge air.

In some embodiments, the vehicle system may further include an aftertreatment system coupled in the exhaust passage upstream and/or downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, three-way catalyst, $NO_x$ trap, or various other devices or systems.

The vehicle system may further include an exhaust gas recirculation (EGR) system 430 coupled to the engine, which routes exhaust gas from the exhaust passage of the engine to the intake passage downstream of the turbocharger. In some embodiments, the exhaust gas recirculation system may be coupled exclusively to a group of one or more donor cylinders of the engine (also referred to a donor cylinder system). As depicted in FIG. 4, the EGR system includes an EGR passage 432 and an EGR cooler 434 to reduce the temperature of the exhaust gas before it enters the intake passage. By introducing exhaust gas to the engine, the amount of available oxygen for combustion is decreased, thereby reducing the combustion flame temperatures and reducing the formation of nitrogen oxides (e.g., $NO_x$). Additionally, the EGR system may include one or more sensors for measuring temperature and pressure of the exhaust gas flowing into and out of the EGR cooler. For example, there may be a temperature and/or pressure sensor 413 positioned upstream of the EGR cooler (e.g., at the exhaust inlet of the EGR cooler) and a temperature and/or pressure sensor 415 positioned downstream of the EGR cooler (e.g., at the exhaust outlet of the EGR cooler). In this way, the controller may measure a temperature and pressure at both the exhaust inlet and outlet of the EGR cooler. The EGR cooler may further include a fouling sensor 451 for detecting an amount of fouling (e.g., deposits built-up on the cooling tubes in in the exhaust passages) within an interior of the EGR cooler. In this way, the controller may directly measure a level (e.g., amount or percentage) of fouling of the EGR cooler. In an alternate embodiment, the EGR cooler may not include the fouling sensor and instead an engine controller may determine an effectiveness of the EGR cooler based on a gas inlet temperature, gas outlet temperature, and coolant (e.g., water) inlet temperature of the EGR cooler.

In some embodiments, the EGR system may further include an EGR valve for controlling an amount of exhaust gas that is recirculated from the exhaust passage of the engine to the intake passage of the engine. The EGR valve may be an on/off valve controlled by a controller 410, or it may control a variable amount of EGR, for example. As shown in the non-limiting example embodiment of FIG. 4, the EGR system is a high-pressure EGR system. In other embodiments, the vehicle system may additionally or alternatively include a low-pressure EGR system, routing EGR from downstream of the turbine to upstream of the compressor.

As depicted in FIG. 4, the vehicle system further includes a cooling system 450 (e.g., engine cooling system). The cooling system circulates coolant through the engine to absorb waste engine heat and distribute the heated coolant to a heat exchanger, such as a radiator 452 (e.g., radiator heat exchanger). In one example, the coolant may be water. A fan 454 may be coupled to the radiator in order to maintain an airflow through the radiator when the vehicle is moving slowly or stopped while the engine is running. In some examples, fan speed may be controlled by the controller. Coolant which is cooled by the radiator may enter a tank (not shown). The coolant may then be pumped by a water, or coolant, pump 456 back to the engine or to another component of the vehicle system, such as the EGR cooler and/or charge air cooler.

As shown in FIG. 4, a coolant/water passage from the pump splits in order to pump coolant (e.g., water) to both the EGR cooler and engine in parallel. The EGR cooler may include a burp/entrained air management system. For example, as shown in FIG. 4, the pump may pump coolant (or cooling water) into a coolant inlet 435 arranged at a bottom (relative to a surface on which the engine system, or vehicle, sits) of the EGR cooler. Coolant may then exit the EGR cooler via a coolant exit 437 arranged at a top of the EGR cooler (the top opposite the bottom of the EGR cooler). Thus, the EGR cooler may be filled with water (or coolant) from the bottom of the EGR cooler to the top via driving force from the pump. In some embodiments, the pump may then be arranged at a bottom of the EGR cooler. In this way, the EGR cooler may be filled with water or coolant through the bottom, thereby pushing air through and out the top of the EGR cooler (e.g., venting the EGR cooler). Thus, coolant may fill and flow through the cooling tubes in a direction opposite that of gravity. Further, there may be one or more additional sensors coupled to the coolant inlet and coolant exit of the EGR cooler for measuring a temperature of the coolant entering and exiting the EGR cooler.

As shown in FIG. 4, an exhaust manifold of the engine includes a heater 411 (or alternate heating element) actuatable by the controller to heat the exhaust manifold and thus also heat the EGR cooler coupled proximate to (e.g., in some examples, adjacent to) the engine. In alternate embodiments, the engine may not include a heater.

The rail vehicle further includes the controller (e.g., engine controller) to control various components related to the rail vehicle. As an example, various components of the vehicle system may be coupled to the controller via a communication channel or data bus. In one example, the controller includes a computer control system. The controller may additionally or alternatively include a memory holding non-transitory computer readable storage media (not shown) including code for enabling on-board monitoring and control of rail vehicle operation. In some examples, the controller may include more than one controller each in communication with one another, such as a first controller to control the engine and a second controller to control other operating parameters of the locomotive (such as tractive motor load, blower speed, etc.). The first controller may be configured to control various actuators based on output received from the second controller and/or the second controller may be configured to control various actuators based on output received from the first controller.

The controller may receive information from a plurality of sensors and may send control signals to a plurality of actuators. The controller, while overseeing control and management of the engine and/or rail vehicle, may be configured to receive signals from a variety of engine sensors, as further elaborated herein, in order to determine operating parameters and operating conditions, and correspondingly adjust various engine actuators to control operation of the engine and/or rail vehicle. For example, the engine controller may receive signals from various engine sensors including, but not limited to, engine speed, engine load, intake manifold air pressure, boost pressure, exhaust pressure, ambient pressure, ambient temperature, exhaust temperature, particulate filter temperature, particulate filter back pressure, engine coolant pressure, gas temperature in the EGR cooler, or the like. The controller may also receive a signal of an amount of oxygen in the exhaust from an exhaust oxygen sensor 462. Additional sensors, such as coolant temperature sensors, may be positioned in the cooling system. Correspondingly, the controller may control the engine and/or the rail vehicle by sending commands to various components such as the traction motors, the alternator/generator, fuel injectors, valves, or the like. For example, the controller may control the operation of a restrictive element (e.g., such as a valve) in the engine cooling system. Other actuators may be coupled to various locations in the rail vehicle.

Figure 5:
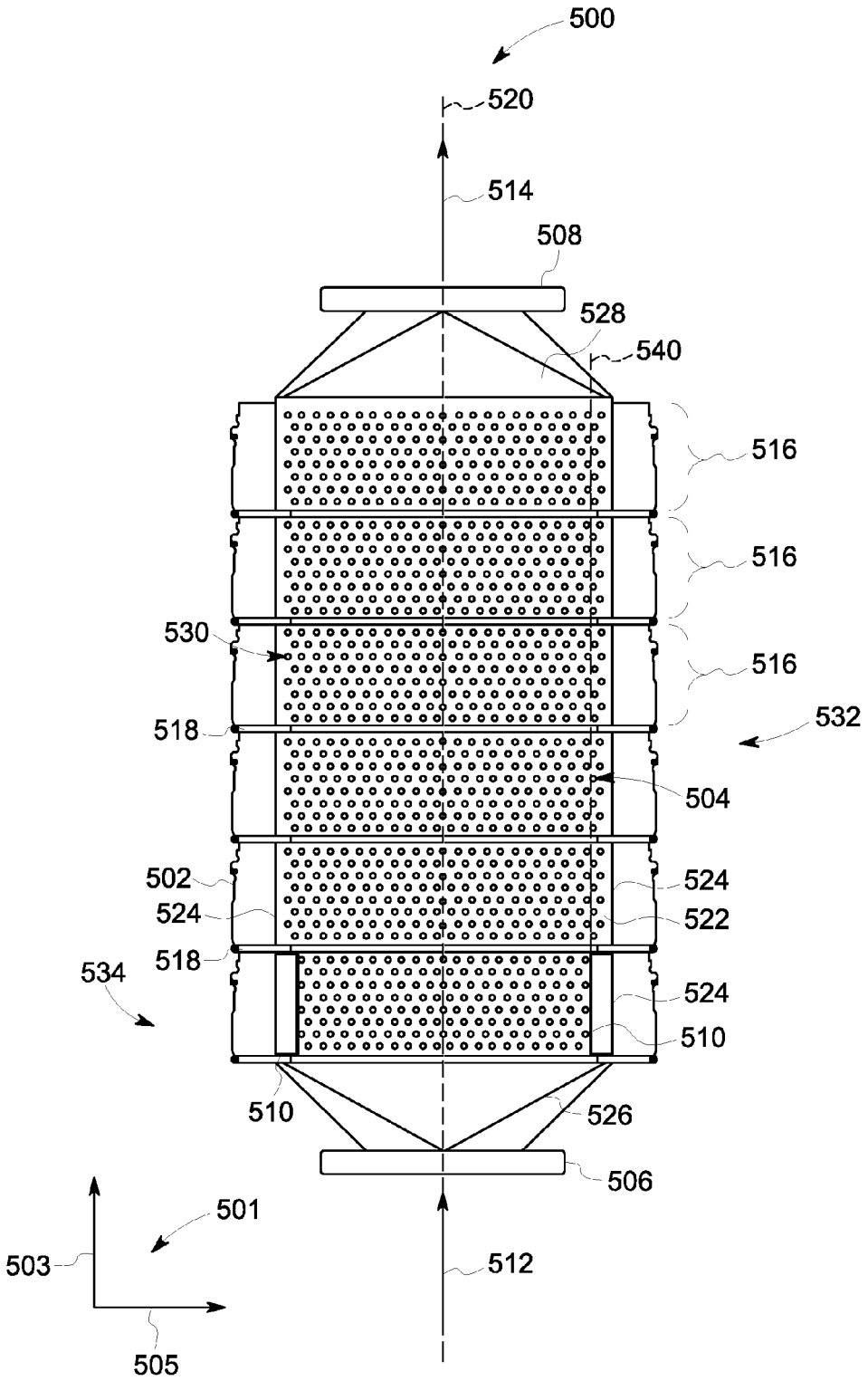
FIG. 5 shows a schematic illustration of an EGR cooler system according to an embodiment of the invention.
Figure 6:
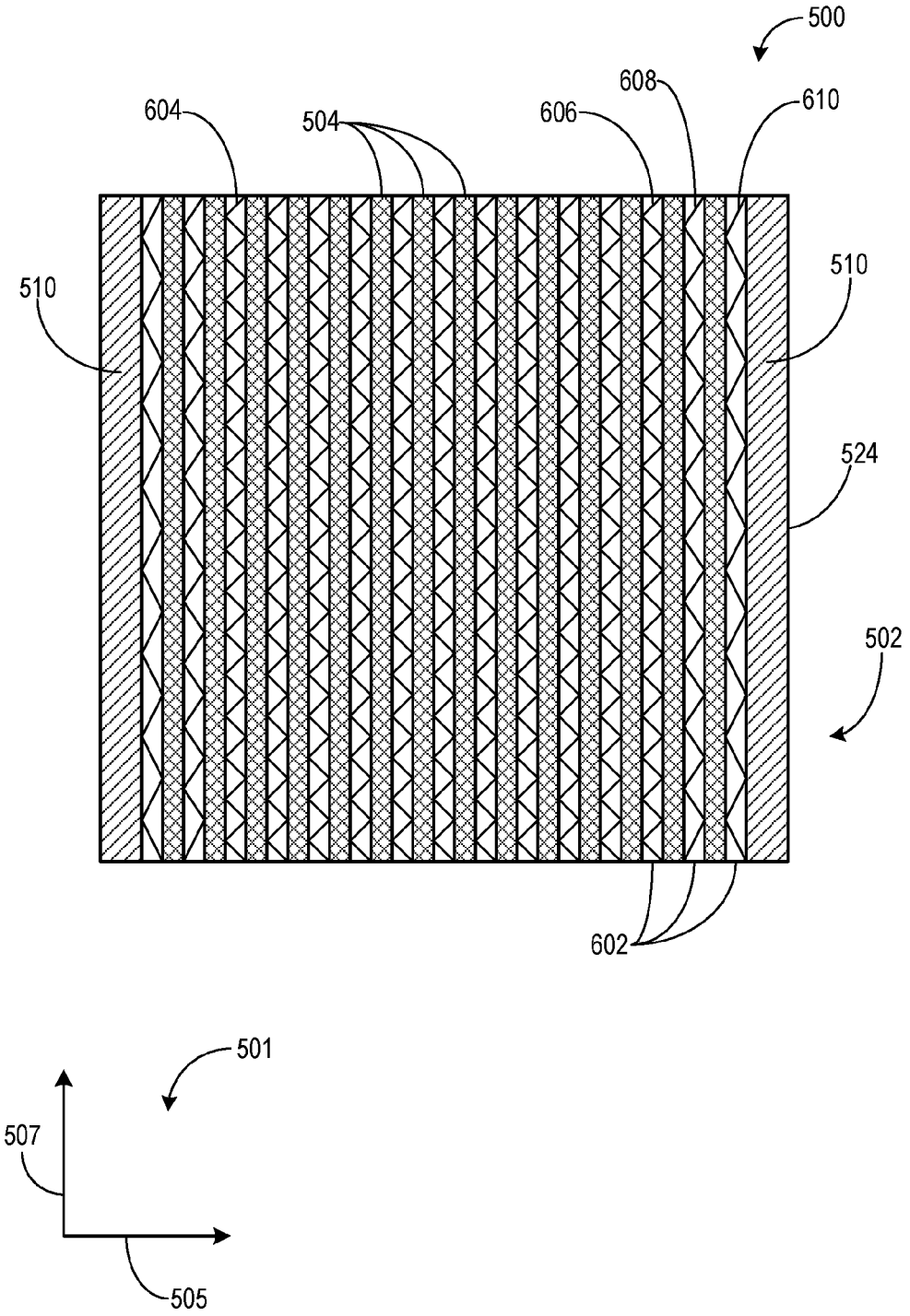
FIG. 6 shows a cross-sectional front view of an EGR cooler according to an embodiment of the invention.
Figure 7:
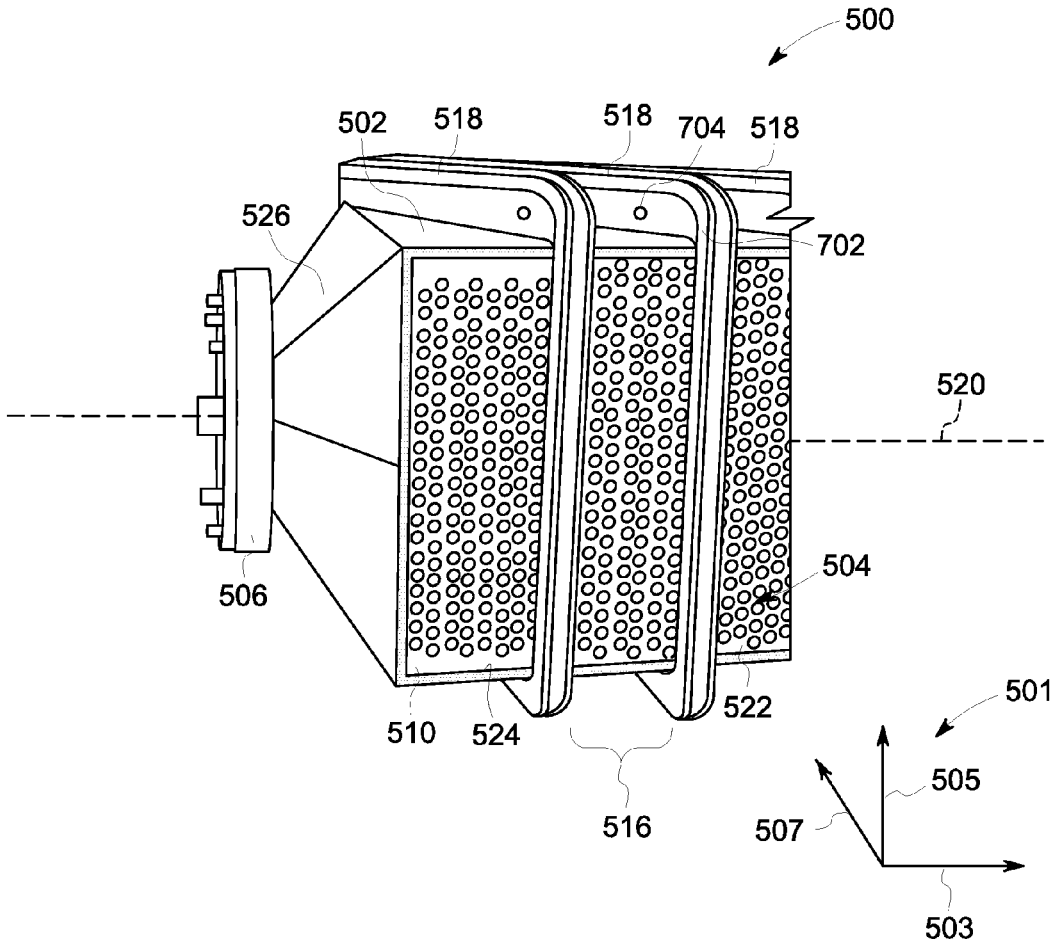
FIG. 7 shows an EGR cooler according to an embodiment of the invention.

With reference to FIGS. 5-7, an EGR cooler 500 is shown. The EGR cooler may be positioned in an engine system, such as one of the engine systems shown in FIG. 1 and FIG. 4). The EGR cooler shown in FIGS. 5-7 may be any of EGR coolers 166, 214, and 434 shown in FIGS. 1, 2, and 4. FIG. 5 shows an exterior side view of the EGR cooler with cooling tube ends exposed, FIG. 6 shows a cross-sectional front view of the EGR cooler, and FIG. 7 shows an isometric view of the EGR cooler. FIGS. 5-7 include an axis system 501 including a vertical axis 505, horizontal axis 507, and lateral axis 503. Further, the EGR cooler includes a central axis 520.

The EGR cooler includes a housing (e.g., outer housing) 502, and a plurality of cooling tubes 504 disposed within the housing. The cooling tubes allow coolant to flow therethrough and exchange heat with exhaust gas that flows through an interior of the housing, outside of the cooling tubes (e.g., outside of exterior walls of the cooling tubes). As shown at 512, hot exhaust gas flows into the housing of the EGR cooler through an inlet 506 and then expands within an inlet manifold 526 before entering a body 532 of the EGR cooler which contains the cooling tubes. After passing through the body and flowing around the cooling tubes, the exhaust gas flows through an outlet manifold 528, and then finally exits the EGR cooler out through an outlet 508, as shown at 514.

As shown in FIGS. 5 and 7, the cooling tubes are arranged in a plurality of bundle groups (e.g., sections) 516 that may each include a plurality of bundles of cooling tubes. In this way, each bundle group includes an array of cooling tubes. An exterior baffle 518 is positioned between each bundle group and extends around an entire outer perimeter of the housing. The exhaust flowing through the body of the EGR cooler is hottest proximate to the inlet and inlet manifold (e.g., since the exhaust gas not been cooled much yet from passing over the cooling tubes). Thus, the cooling tubes closest to the inlet and inlet manifold (relative to cooling tubes in the middle or closer to the outlet of the EGR cooler) and closest to interior sidewalls 524 of the housing of the EGR cooler (e.g., closer than the cooling tubes proximate to the central axis of the EGR cooler) may experience increased thermal stress. Specifically, these cooling tubes may expand due to the hotter exhaust gas flowing around them from the EGR cooler inlet. However, since these cooling tubes are positioned adjacent to the internal sidewalls of the EGR cooler housing, they may not have enough room to expand and, as a result, may experience structural buckling and degradation. As a result, the cooling tubes may degrade and result in coolant leaks and/or reduced cooling of the exhaust gas flowing through the EGR cooler.

To overcome these issues, the leading cooling tubes of the EGR cooler that are positioned closest to the inlet and adjacent to the interior sidewalls of the housing (relative to the rest of the cooling tubes closer to the central axis of the EGR cooler and/or arranged more downstream in the EGR cooler, relative to the flow path of exhaust gas through the EGR cooler) may be removed from the EGR cooler and replaced by one or more interior baffles 510, as shown in FIGS. 5-7.

As shown in FIGS. 5 and 7, the EGR cooler includes two interior baffles positioned proximate to the inlet manifold, within a first bundle group (e.g., section) 534 of the EGR cooler. The first bundle group is positioned between the inlet manifold and a first exterior baffle of the EGR cooler (e.g., the exterior baffle closest to the inlet relative to the other exterior baffles of the EGR cooler). Specifically, in the first bundle group, the leading cooling tubes closest to the interior sidewalls, on both sides of the EGR cooler (e.g., sides opposite one another across the central axis and that run along a length of the cooling tubes, in a direction of the horizontal axis and a direction of flow through the cooling tubes), are removed from the bundle group and the interior baffles are arranged in their place. As shown in FIGS. 5 and 6, each interior baffle is a C-channel (extruded into the page in FIG. 5, in a direction of the horizontal axis). The ends of the walls of the C-channel of the interior baffles (e.g., ends of the "C") are directly coupled (e.g., via welding) to the interior sidewalls of the EGR cooler housing. In alternate embodiments, the interior baffles may take a shape other than a C-channel, such as a T shape. In still other embodiments, the interior baffles may be attached to the interior sidewalls of the housing in alternate ways or on alternate surface of the interior baffles. The purpose of the interior baffle(s) is to block exhaust flow from flowing through a section of the EGR cooler not containing cooling tubes. Thus, the interior baffles may be shaped and sized to accomplish this purpose and thus may take different forms. In some examples, instead of an interior baffle, fins in the region of the EGR cooler not having cooling tubes may be bound together to block incoming exhaust flow from passing through that region.

Additionally, each interior baffle has a width, in a direction of the vertical axis, which extends from a respective interior sidewall of the EGR cooler housing to the remaining cooling tubes of the first bundle group that are closest to the interior sidewall. As shown in FIG. 5, an outer edge of the baffle that faces the cooling tubes within the first bundle group extends to line 540 from the interior sidewall. In the region of the interior baffles, in the first bundle group, there are no cooling tubes between line 540 and the sidewall. However, in the bundle groups behind and downstream from the first bundle groups, in a direction of exhaust gas flow through the EGR cooler, there are cooling tubes in this region (between line 540 and the sidewall). In this way, cooling tubes are positioned behind, in a direction of exhaust gas flow, outer edges of the baffles, within bundle groups adjacent to the first bundle group. For example, a second bundle group positioned adjacent to and downstream from the first bundle group includes cooling tubes between the line 540 that is in-line with the outer edge of the baffle and the interior sidewall of the housing. As also shown in FIG. 5, a first baffle of the two interior baffles is positioned between a first sidewall of the housing and the cooling tubes in the first bundle group and a second baffle of the two interior baffles is positioned between a second sidewall of the housing and the cooling tubes in the first bundle group. Edges of the first baffle and second baffle are positioned forward of the second bundle group relative to the exhaust inlet. Further, a width of each bundle group may be defined between an outermost tube of the bundle group on a first side of the bundle group and an outermost tube of the bundle group on a second side of the bundle group, the second side opposite the first side. As such, a width of the first bundle group including the interior baffles is narrower than a width of the second bundle group since the outermost cooling tubes within the second bundle group extend all the way to the sidewalls of the housing of the EGR cooler.

A front face of the interior baffle, arranged in a plane of the horizontal and vertical axis, as shown in FIG. 6, blocks exhaust gas from flowing through the portion of the first bundle without cooling tubes. The interior baffles guide exhaust gas flow through the remaining cooling tubes of the EGR cooler. This arrangement allows for the expansion of exhaust gas prior to contacting the first (e.g., nearest to the inlet) of the cooling tubes within the EGR cooler. The interior baffles reduce impact, erosion, and buckling on the remaining lead cooling tubes in the first bundle group. Alternatively, in another embodiment, instead of removing the leading cooling tubes closest to the internal sidewalls of the EGR cooler housing, these cooling tubes may instead be made of heavier gage material than those cooling tubes that are distal from the inlet and interior sidewalls. In one embodiment, cooling tubes of different composition and/or size/thickness are proximate the inlet. The composition is selected from those having relatively higher erosion resistance, and thermal fatigue and thermal stress resistance than the material of the other cooling tubes.

As shown in FIGS. 5 and 7, only the first bundle group includes the interior baffle and no other bundle groups (other than the first bundle group closest to the inlet of the EGR cooler) include an interior baffle at the interior sidewalls of the housing of the EGR cooler. Instead, the other bundle groups have cooling tubes positioned adjacent to and at the interior sidewalls of the housing of the EGR cooler.

As seen in FIGS. 5 and 7, for each bundle group, ends of the cooling tubes are arranged at a tube sheet 522. For example, there may be a first tube sheet for a first end of each cooling tube within one bundle group and a second tube sheet for an opposite, second end of each cooling tube within the one bundle group. Each tube sheet extends across the EGR cooler, in a direction of the vertical axis, between opposite interior sidewalls of the housing. Each tube sheet also extends in a direction of the lateral axis, between two adjacent exterior baffles (or between an exterior baffle and the inlet manifold or outlet manifold of the EGR cooler, in the case of the outermost bundle groups). For each bundle group, ends of the cooling tubes within that bundle group may be welded to the corresponding tubes sheet via entry welds. As indicated at 530 in FIG. 5, the entry welds are circumferential welds around a circumference of each cooling tube that connect each cooling tube end to the corresponding tube sheet. As shown in FIGS. 5 and 7, the entry welds on the side tubes that are replaced by the interior baffles may be eliminated in order to remove the identified tubes and include the above-described interior baffle.

In an alternate embodiment, the cooling tubes may be rolled into the corresponding tube sheet instead of welded. In this embodiment, each cooling tube may be mechanically expanded into the tube sheet.

The tube sheets are coupled at a first end (e.g., sidewall) of the tube sheet to a first sidewall of the housing and at a second end (e.g., sidewall) of the tube sheet to a second sidewall of the housing, the second sidewall opposite the first sidewall across the central axis of the EGR cooler housing. FIG. 8 shows a schematic 800 of an arrangement of the tube sheet and sidewall of the EGR cooler housing. The tube sheets of the EGR cooler are welded to the sidewalls of the EGR cooler housing. However, the angle between the housing sidewall and the tube sheet may affect the ease of welding these two components together and, more specifically, the percentage weld penetration. As shown in FIG. 8, the EGR cooler housing sidewall 802 (e.g., such as one of the sidewalls 524 shown in FIG. 5) is positioned adjacent to and contacting a tube sheet 804 (e.g., such as one of tube sheets 522 shown in FIGS. 5 and 7). The sidewall includes a bevel 805 along an edge of the sidewall that faces the tube sheet. The bevel of the sidewall has an angle 806. In one example, the angle of the sidewall bevel is about 45 degrees (e.g., 45 degrees+/−0.5 degrees). In another example, the angle of the sidewall bevel is in a range of 43-47 degrees. The tube sheet includes a bevel 807 along an edge of the tube sheet that faces the EGR cooler housing sidewall. The bevel of the tube sheet has an angle 808. In one example, the angle of the bevel is about 25 degrees (e.g., 25 degrees+/−0.5 degrees). In another example, the angle of the tube sheet bevel is in a range of 23-27 degrees. When the angle of the sidewalls is approximately 70 degrees, this gives a total bevel angle of approximately 70 degrees. The weld is formed within the space created by the total bevel angle. This increased angle allows for complete (e.g., 100% weld penetration) when a weld bead is placed within the space created between the bevels of the sidewall and tube sheet. The first bevel of the housing sidewall and the second bevel of the tube sheet, along with the weld formed therein, form a welded seem 810.

As shown in FIG. 7, the exterior baffles of the EGR cooler may be sealed using a polymeric material, as shown at sealing region 702. The sealing region having the sealing material is positioned around an entire outer perimeter of each exterior baffle, with the sealing material extending inward, toward the housing and a central axis 520 of the EGR cooler, along a portion of the exterior baffle. In one example, the polymeric sealing material used in the sealing region may be a fluoropolymer (e.g., fluoroelastomer) that includes an alternating copolymer of tetrafluoroethylene and propylene.

As also shown in FIG. 7, the EGR cooler may include one or more apertures 704, which serve as drains, arranged in outer sidewalls of the exterior baffles of the EGR cooler. For example, these apertures may be arranged in a top and bottom of the exterior baffles (only top visible in FIG. 7), interior to the sealing region along the outer perimeter of each exterior baffle but interior to the housing of the EGR cooler. In another example, these apertures may be arranged in sides of the exterior baffles (e.g., in a portion of the exterior baffles arranged along the vertical axis 505 shown in FIG. 7). In one example, each exterior baffle may include one or more apertures in a top and bottom wall of the exterior baffle. In another example, only a portion of all the exterior baffles may include one or more drain apertures in the top and bottom wall of the exterior baffle. The size (e.g., diameter), shape (e.g., circular, oval, square), and/or number of the apertures may be selected to achieve a drain rate less than a threshold duration. In one example, the threshold duration may be approximately five minutes. In another example, the threshold duration may be greater or less than five minutes (such as 15 minutes). For example, the drain rate, in one example, may be approximately 15 minutes for water (when water is the coolant used in the EGR cooler), or another fluid with a similar viscosity. This may reduce freezing within the EGR cooler.

Another way to reduce thermal stress on the leading cooling tubes proximate to the EGR cooler inlet and interior sidewalls of the EGR cooler housing includes decreasing the fin density within the regions of these leading cooling tubes. This feature is illustrated in FIG. 6. As shown in FIG. 6, the EGR cooler includes a plurality of cooling tubes 504 arranged across the EGR cooler and internal baffles 510 on opposite sides of the EGR cooler (replacing a portion of the leading cooling tubes). The EGR cooler also includes a plurality of gas passages 602 through which exhaust gas flows. The gas passages are arranged between the cooling tubes and include fins 604 which increase the cross-sectional area for heat transfer between the exhaust gas and cooling tubes. However, this may result in increased thermal expansion of the cooling tubes near the EGR cooler inlet, thereby resulting in degradation of the cooling tubes closest to the EGR cooler housing sidewalls. Thus, in order to reduce thermal stress on the cooling tubes proximate to the inlet and housing sidewalls, the fin density around these tubes may be reduced. As shown in FIG. 6, the fins surrounding the cooling tubes near a center of the EGR cooler have a first fin density 606. The cooling tubes closest to the internal baffle and housing sidewalls may have a second fin density 610 which is less than the first fin density. In this way, less fins may surround the cooling tubes closest to the sidewalls and near the inlet of the EGR cooler. In some examples, the fin density (e.g., number of fins) may decrease gradually from a center of the EGR cooler to the housing sidewalls (e.g., as shown by the decreasing fin densities shown at 606, 608, and 610). As a result, the cooling tubes with fewer fins may experience a lower heat transfer rate with the exhaust gas and thus less thermal expansion and degradation at the sidewalls of the EGR cooler. In one example, the EGR cooler fin density may be less than a threshold number of fins per threshold area. For example the EGR cooler fin density near the sidewalls of the housing may be decreased by 50% or greater than the fin density closer to a center (e.g., central axis) of the EGR cooler.

Over time, due to exhaust gas flowing through the EGR cooler, the EGR cooler may become fouled (e.g., deposits may build up within the EGR cooler and on outer surface of the cooling tubes. This increase in EGR cooler fouling may increase a resistance of exhaust flow through the EGR cooler and decrease the cooling effectiveness of the EGR cooler. In order to reduce and/or remove deposits from the EGR cooler and clean the EGR cooler during engine operation (e.g., while the EGR cooler continues to operate without shutting down the engine), a controller of the engine system (such as controller 130 shown in FIG. 1 or controller 410 shown in FIG. 4) may engage an EGR cooler cleaning mode of operation in response to one or more triggers. As described further below, suitable triggers may include time, an EGR cooler effectiveness estimate (based on EGR cooler gas inlet temperature, gas outlet temperature, and coolant intler temperature), pressure drop across the EGR cooler, an output of a sensor that measures fouling directly in the EGR cooler, and/or a loss of temperature differential between the intake and the outlet on the EGR cooler. The EGR cooler cleaning mode of operation may engage less often over the life of the engine. During the EGR cooler cleaning mode of operation, fouling materials may be removed from the EGR cooler. Suitable EGR cooler cleaning modes are described below.

The engagement frequency for the EGR cleaning operating mode may be based at least in part on one or more of the age of the engine, the age of the EGR cooler, the type of engine, the engine duty cycle, the time to last oil-change or the time to next oil-change, and the like. Alternatively, it may be a health parameter of the EGR cooler that initiates the cleaning operating mode.

Turning to FIG. 9, a method 900 is shown for initiating a cleaning mode of the EGR cooler (such as any of the EGR coolers disclosed herein with reference to FIGS. 1, 2, and 4-8) in order to reduce or remove fouling material within the EGR cooler. Method 900 may be executed by an engine controller (such as controller 130 shown in FIG. 1 or controller 410 shown in FIG. 4) according to instructions stored in a non-transitory memory of the controller and in conjunction with a plurality of sensors (e.g., various temperature and pressure sensors of the engine system) and actuators (e.g., such as actuators of fuel injectors, heaters, pumps, or the like) of the engine system in which the EGR cooler is included.

At 902, the method includes estimating and/or measuring engine operating conditions. Engine operating conditions may include one or more of engine speed and load, engine temperature, exhaust gas temperature at the exhaust inlet and outlet of the EGR cooler, coolant temperature at a coolant inlet and outlet of the EGR cooler, a pressure drop across the EGR cooler (e.g., pressure difference between the exhaust inlet and outlet of the EGR cooler), an amount of fouling of the EGR cooler, a duration of engine operation, and the like.

At 904, the method includes determining a level of fouling in the EGR cooler (e.g., an amount of fouling within an interior of the EGR cooler). The level of fouling in the EGR cooler may be based on one or more of an EGR cooler effectiveness estimate, a pressure drop across the EGR cooler (e.g., a difference in pressure between the exhaust gas inlet and outlet of the EGR cooler), an amount of fouling of the EGR cooler based on an output of a sensor that measures fouling directly in the EGR cooler (such as sensor 451 shown in FIG. 4), a temperature difference between the exhaust inlet and outlet of the EGR cooler, and/or a temperature difference between the coolant inlet and outlet of the EGR cooler. In one example, the level of fouling of the EGR cooler may be based on one or more of the above parameters relative to set thresholds or threshold ranges. In another example, the level of fouling of the EGR cooler may be based on each of the above parameters.

At 906, the method includes determining if the fouling level is above a set, first threshold level. In one example, determining if the fouling level is above the first threshold includes determining if a pressure difference across the EGR cooler (e.g., pressure difference between the exhaust gas inlet and outlet) is greater than a threshold pressure difference. In another example, determining if the fouling level is above the first threshold includes determining if a temperature differential between the exhaust gas inlet and outlet of the EGR cooler is not greater than a threshold. For example, if the temperature of the exhaust gas at the outlet of the EGR cooler is not a threshold amount different than the exhaust gas at the inlet, then the effectiveness of the EGR cooler may be decreased due to fouling. In yet another example, determining if the fouling level is above the first threshold includes determining if an amount of fouling (as determined by a fouling sensor within the EGR cooler) within the EGR cooler is greater than a threshold amount. In this way, a health parameter of the EGR cooler may initiate the cleaning operating mode.

If the fouling level is not greater than the first threshold, the method continues to 908 to determine if it is time to pro-actively initiate a cleaning operating mode of the EGR cooler. As one example, the method at 908 may include determining if a threshold duration has passed since a previous EGR cooler cleaning operation. In this way, the EGR cooler may be pro-actively cleaned via a cleaning mode initiated by the controller at a set engagement frequency. The engagement frequency for the EGR cleaning operating mode may be based at least in part on one or more of the age of the engine, the age of the EGR cooler, the type of engine, the engine duty cycle, the time to last oil-change or the time to next oil-change, and the like.

If it is not time to initiate cleaning of the EGR cooler, the method continues to 910 to continue operating the engine without cleaning the EGR cooler. The method then ends. However, if either it is time to initiate a cleaning mode of the EGR cooler and/or the fouling level of the EGR cooler is above the threshold level, the method continues to 912 to determine if conditions are met for cleaning or reducing fouling of the EGR cooler via port heating. In one example, conditions for enabling a port heating cleaning mode include the engine operating at idle or during dynamic braking. For example, in one embodiment, port heating may be performed with any reverser handle position—e.g., any operating mode where the notch call is zero. Further, when locomotives are the vehicles in which the engine is installed, and there are two or more locomotives in consist, one locomotive may communicate to the other so that neither of the locomotives are in port heating operating mode at the same time. In another example, conditions for port heating may be met when engine load is below a threshold (e.g., low load) and after the engine has experienced conditions that put the engine at risk for oil in the exhaust (e.g., after the engine has been at low load for a duration that may be a relatively extended period of time). In yet another example, the controller may determine one or more of an accumulated engine revolutions at low or no load, the load amount, and engine revolutions as a function of MW-hrs as at least one factor in determining whether to initiate the EGR cooler cleaning mode of operation.

If conditions for initiating the port heating cleaning mode are met at 912, the method continues to 914 to initiate port heating. In one embodiment, a port heating event may include over-fueling (e.g., via actuating a fuel injector of at least one cylinder to increase the amount of fuel injected into the cylinder) a determined number of cylinders. The determined number of cylinders may include one or more of the engine cylinders. An amount of over-fueling (e.g., amount of additional fuel injected) may be based on one or more of the age of the engine, the age of the EGR cooler, the type of engine, the engine duty cycle, the time to last oil-change or the time to next oil-change, and the like. In some example, the EGR cooler cleaning operating mode may be accomplished at a determined speed other than at idle or at low load/speed. Further, the period of time for which the system is operated in the port heating mode may be controlled based on at least one or more of the following: the number of cylinders being used, the period of time since the last cleaning event, the amount of pressure dropped sensed through the EGR cooler, other engine performance perimeters, and the like. The frequency or the period between port heating cycles may be further determined based on one or more of the following: time, a measure of the accumulated engine revolutions at low or no load, the load amount, and engine revolutions as a function of MW-hrs of accumulated use of the engine and/or the EGR cooler. After the period of time for port heating has expired, the method continues to 916 to terminate the EGR cooler cleaning mode and continue operating the engine. In this way, port heating may heat the exhaust that passes through the EGR cooler, thereby burning off and removing the deposits (e.g., oil deposits).

Returning to 912, if the conditions for port heating are not met, the method continues to 918 to activate an alternate cleaning mode of the EGR cooler (which may include initiating one or more of the methods shown at 918). As shown at 920, activating an alternate cleaning operating mode may include, providing via the controller late fuel injection and/or late post injections to one or more engine cylinders. This may include activating one or more fuel injectors to retard the timing of regular or post fuel injection events at one or more cylinders. In another example, at 922, activating an alternate cleaning mode may include auto-loading the engine while operating in idle. If extended idle presents a need to remove oil carry-over, the system would transition itself into a self-load mode. The self-load mode causes the engine to generate power that is then dissipated in the dynamic braking grids (rather than as motive force from the traction motors). The engine would make enough power to heat the exhaust and to remove the oil (e.g., fouling material). In yet another example, at 924, activating an alternate cleaning mode may include actuating the exhaust valves to back-pressure the engine. Such back pressuring may make the engine perform indicated work (due to pumping losses) without it being brake work. In another example, at 926, activating an alternate cleaning mode may include actuating an electrical or other heater element in the exhaust manifold which would heat the EGR cooler (e.g., due to the EGR cooler being positioned proximate to the exhaust manifold) without the need to raise the exhaust gas temperature.

From 916 and 918, the method continues to 928 set a diagnostic flag for cleaning the EGR cooler once the engine is shut down based on one or more of a number of times an active cleaning operating mode has been executed (e.g., one of the methods at 914 and 918), a rate of fouling of the EGR cooler (which may be based on the determined level of fouling at the EGR cooler and/or a frequency of the EGR cooler cleaning mode operation), and/or a determined level of fouling in the EGR cooler being above a second threshold which is greater than the threshold at 904. For example, the method at 928 may include providing a signal for maintenance to one or more of the operator of the equipment, a service or maintenance shop, and a back office that monitors and schedules maintenance and repairs for equipment.

At 930, the method may optionally include determining if the level of fouling and/or frequency of EGR cooler cleaning events are greater than a second threshold. As an example, the second threshold may be a level that is higher than the level for initiating an active EGR cooler cleaning mode while the engine is running and a threshold that indicates that the effectiveness of the EGR cooler is reduced below a lower threshold level. If such a level has not been reached at 930 the method continues to 932 to continue engine operation. Otherwise, if such a level or frequency has been reached at 930, the method continues to 934 to shut down the engine and indicate that manual cleaning operation of the EGR cooler is required. A system and method for executing a manual cleaning operation of the EGR cooler is shown at FIGS. 10 and 11, as described further below.

In one embodiment, the EGR cooler may be cleaned by uncoupling the EGR cooler from the exhaust system (or a port is opened to provide access). A cleaning solution may be added to the interior of the EGR cooler, and allowed to soak. The now-soiled solution is drained and the process is repeated until a desired level of cleanliness is achieved. Suitable cleaning solutions may include low-foaming salts, such as tri-sodium phosphate, which are commercially available. In another embodiment, the EGR cooler may be cleaned via a cleaning system while coupled to the engine.

Figure 10:
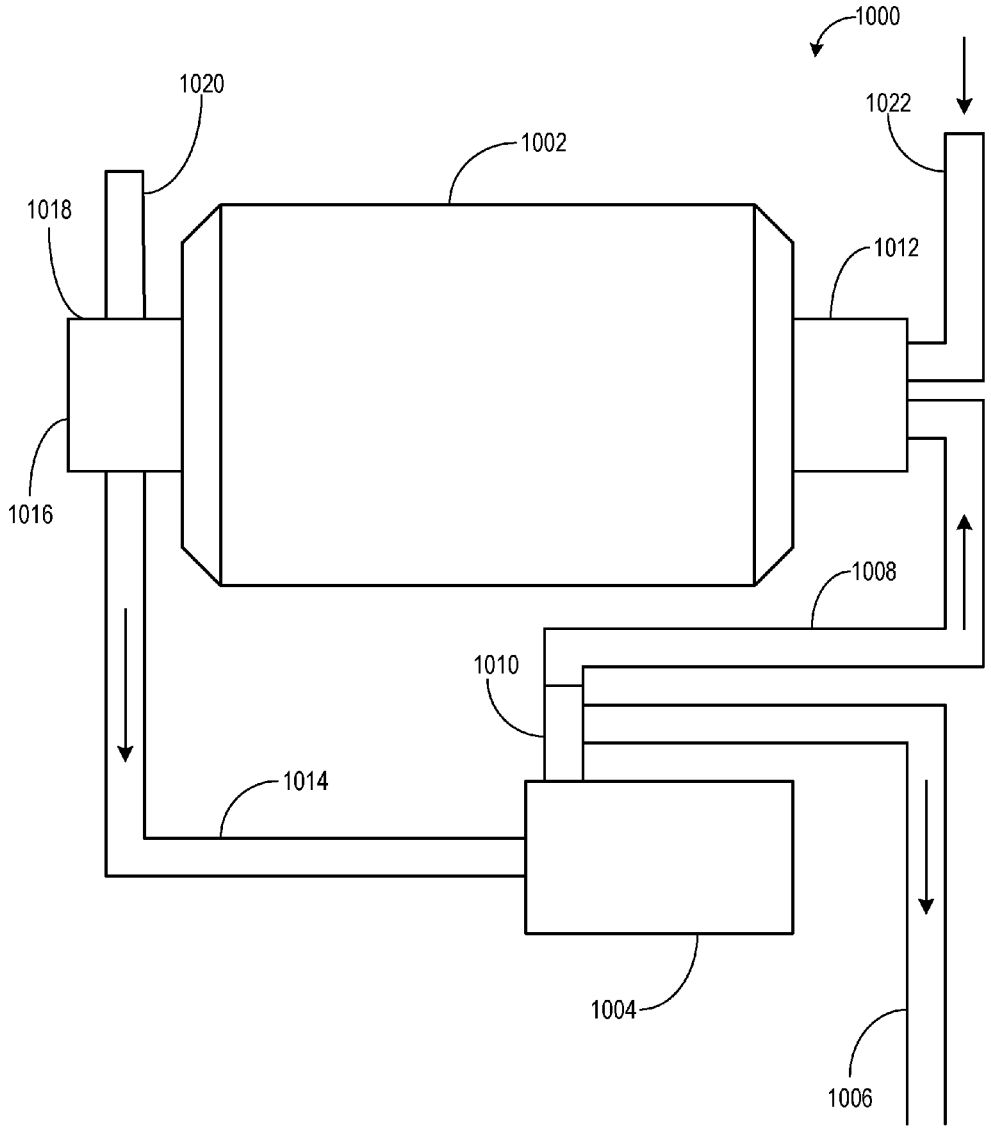
FIG. 10 shows a cleaning system for an EGR cooler according to an embodiment of the invention.
Figure 11:
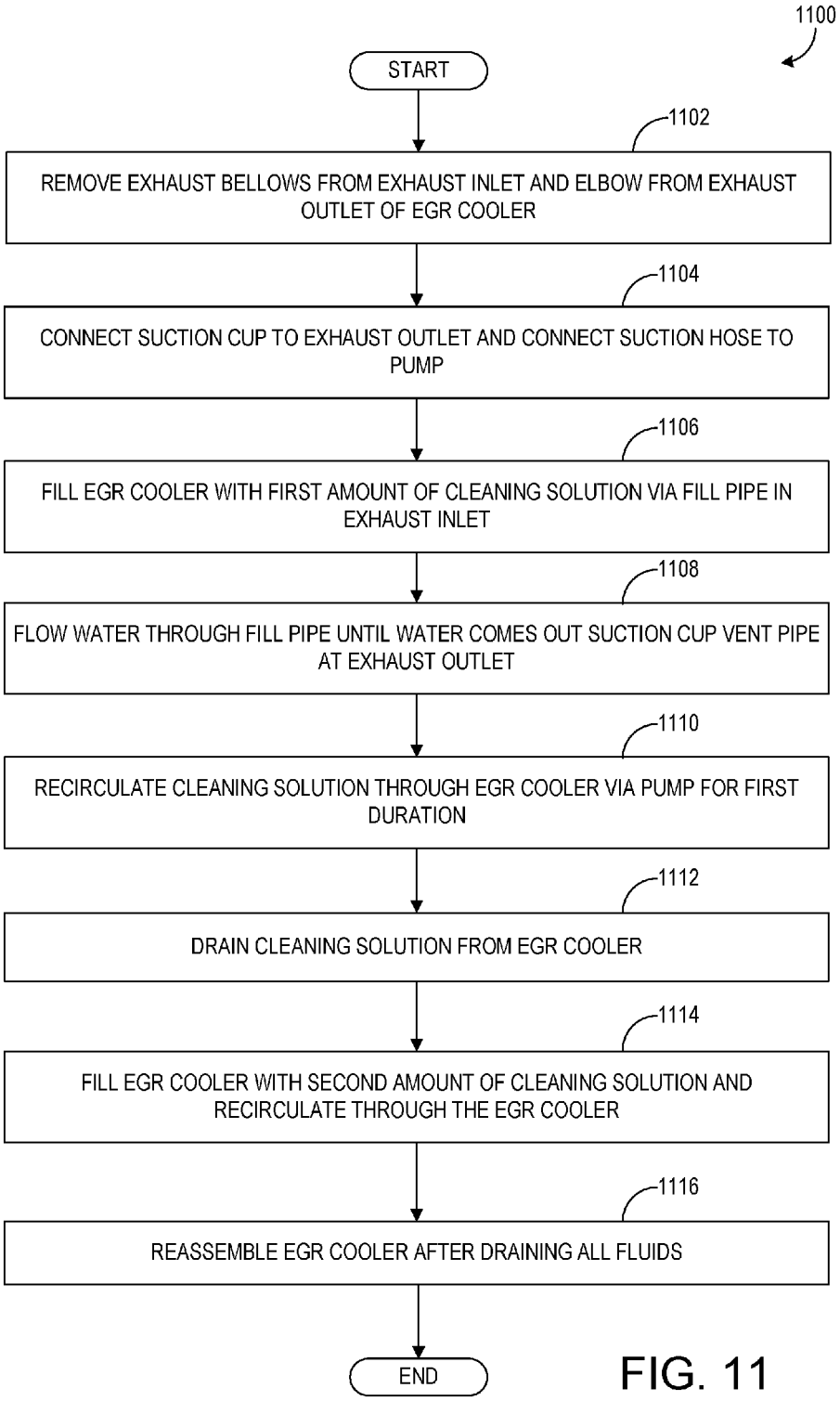
FIG. 11 shows a flow chart of a method for cleaning an EGR cooler via a cleaning system according to an embodiment of the invention.

FIG. 10 shows an embodiment of a system for cleaning a gas-side of the EGR cooler. The system may be referred to as a fill and flush system that may fully fill and flush the EGR cooler while coupled to the engine. Instead of removing the cooler, disassembling, and hot tanking the heat exchanger, all work can be done on engine with non-toxic solvents and water. The device and process allows the cooler to be almost completely filled by the cleaning solution, and then almost completely drained without using pumps or vacuums.

Specifically, FIG. 10 shows a cleaning system 1000 for cleaning the EGR cooler 1002 (which may be any one of the EGR coolers described herein and shown in FIGS. 1-2, 4, and 5-8). The cleaning system includes a pump 1004 for pumping fluids through and out of the EGR cooler. A drain hose 1006 is coupled to the pump and may route fluid from the EGR cooler and pump system to a drain. A recirculation hose 1008 is also directly coupled to the pump at a fitting 1010 of the pump. A second end of the recirculation hose is coupled to an exhaust inlet 1012 of the EGR cooler. In one example, the fitting may include a valve switchable between a pumping mode where fluid is routed out of the pump via the recirculation hose and a drain mode where fluid is routed out of the pump via the drain hose. A suction hose 1014 is coupled between an exhaust outlet 1016 of the EGR cooler and the pump. Specifically, a first end of the suction hose is directly coupled to a manifold 1018 positioned around and over the exhaust outlet. In this way, the manifold may completely cover an opening of the exhaust outlet. A vent pipe 1020 is also directly coupled to the manifold. A fill pipe 1022 is also directly coupled to the exhaust inlet for filling the EGR cooler with cleaning solution and/or water.

FIG. 11 shows a method 1100 for cleaning the EGR cooler via a cleaning system, such as the cleaning system shown in FIG. 10. At 1102, the method includes removing an exhaust bellows section of the exhaust inlet of the EGR cooler and removing an elbow from the exhaust outlet of the EGR cooler. At 1104, the method includes connecting the manifold (e.g., manifold 1018 in FIG. 10) to the exhaust outlet of the EGR cooler and connecting the suction hose (e.g., suction hose 1014 in FIG. 10) from the manifold to the pump (e.g., pump 1004 in FIG. 10). The method at 1104 may include applying a Victaulic coupling gasket to the exhaust outlet. At 1106, the method includes filling the EGR cooler via the fill pipe (e.g., fill pipe 1022) in the exhaust inlet with a first amount of cleaning solution. In one example, the amount of cleaning solution may be approximately four gallons. However, the volume may be based on an internal volume of the EGR cooler. At 1108, the method includes flowing water through the fill pipe until water comes out the manifold vent pipe (e.g., vent pipe 1020 in FIG. 10) at the exhaust outlet. At 1110, the method includes inserting the recirculation hose (e.g., recirculation hose 1008 in FIG. 10) into the exhaust inlet, turning the pump on in pump mode, and recirculating the cleaning solution through the EGR cooler for a first duration (e.g., via flowing the cleaning solution through the reticulation hose, from the pump to the EGR cooler, through the EGR cooler, out the suction hose, and back to the pump). In one example, the duration is approximately one hour.

At 1112, the method includes turning the pump to drain mode and draining the cleaning solution from the EGR cooler via the suction hose and drain hose (e.g., drain hose 1006 in FIG. 10) coupled to the pump while filling the EGR cooler with water via the fill pipe for a second duration. All the water is then drained from the EGR cooler. At 1114, the method includes stopping the pump and filling the EGR cooler with a second amount of cleaning solution and recirculating the second amount of cleaning solution through the EGR cooler and repeating the methods described at 1106, 1108, 1110, and 1112. At 1116, the method includes removing the manifold from the exhaust outlet, vacuuming out the remaining water, and reassembling the EGR cooler. In this way, the EGR cooler may be flushed and cleaned, thereby removing fouling materials from the EGR cooler.

FIGS. 5-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As one embodiment, an exhaust gas recirculation cooler comprises an exhaust gas inlet and an exhaust gas outlet spaced from the exhaust gas inlet; a plurality of cooling tubes disposed between the exhaust gas inlet and exhaust gas outlet; and a baffle positioned proximate to the exhaust gas inlet and interposed between the plurality of cooling tubes and the exhaust gas inlet, where the baffle directs exhaust gas entering the EGR cooler through the exhaust gas inlet to the plurality of cooling tubes in a defined path. In a first example of the EGR cooler, the baffle is positioned between a sidewall of a housing of the EGR cooler and a first group of cooling tubes of the plurality of cooling tubes that is positioned proximate to the inlet. In a second example, of the EGR cooler, the plurality of cooling tubes further comprises a second group of cooling tubes positioned downstream from the first group of cooling tubes, relative to a direction of exhaust gas flow through the EGR cooler, and the baffle is positioned between the inlet and the second group of cooling tubes and between the sidewall and the first group of cooling tubes. In a third example of the EGR cooler, cooling tubes of the second group of cooling tubes are positioned behind, in a downstream direction, the baffle and wherein there are no cooling tubes positioned within a space occupied by the baffle. In a fourth example of the EGR cooler, the baffle is a first baffle positioned between a first sidewall of the housing and the first group of cooling tubes and further comprising a second baffle positioned between a second sidewall of the housing and the first group of cooling tubes, where the second sidewall is positioned opposite the first sidewall across a central axis of the EGR cooler. In a fifth example of the EGR cooler, the EGR cooler further comprises a tube sheet extending across the EGR cooler between opposite interior sidewalls of a housing of the EGR cooler, wherein ends of cooling tubes of the plurality of cooling tubes are arranged at the tube sheet. In a sixth example of the EGR cooler, the EGR cooler further comprises a welded seam between a first beveled edge of an interior sidewall of the housing and a second beveled edge of the tube sheet. In a seventh example of the EGR cooler, the first beveled edge is at an angle of about 45 degrees and the second beveled edge is at an angle of about 25 degrees. In an eighth example of the EGR cooler, the EGR cooler further comprising a plurality of fins positioned between cooling tubes of plurality of cooling tubes, wherein a fin density of the plurality of fins is smaller proximate to an interior sidewall of a housing of the EGR cooler than at a center of the EGR cooler. In one example, the fin density proximate to the exhaust gas inlet and the interior sidewall is less than 50% of a fin density proximate to the exhaust outlet. In a ninth example of the EGR cooler, the EGR cooler further comprises exterior baffles extending around an outer perimeter of a housing of the EGR cooler and spaced apart from one another, where sealing material around outer perimeter of exterior baffles, wherein each exterior baffle of the exterior baffles includes a polymeric sealing material positioned around an entire outer perimeter of the exterior baffle. In one example, the sealing material is fluoropolymer including an alternating copolymer of tetrafluoroethylene and propylene. In yet another example of the EGR cooler, the EGR cooler further comprises at least one aperture arranged in one or more of the exterior baffles, sized and shaped to provide a drain rate of under 15 minutes. In another example of the EGR cooler, the EGR cooler further comprises a coolant inlet fluidly coupled with the plurality of cooling tubes and arranged at a bottom of the EGR cooler and a coolant outlet fluidly coupled with the plurality of cooling tubes and arranged at a top of the EGR cooler, wherein coolant passes through the cooling tubes from the coolant inlet to the coolant outlet.

In another embodiment, an exhaust gas recirculation (EGR) cooler comprises: a plurality of cooling tubes disposed between an exhaust inlet and outlet of the EGR cooler; a housing surrounding and enclosing the plurality of cooling tubes within the EGR cooler, the housing including a plurality of exterior baffles spaced apart from one another along a length of the EGR cooler, in a direction of exhaust flow through the EGR cooler, each exterior baffle of the plurality of exterior baffles extending around an entire outer perimeter of the housing and including a polymeric sealing material positioned around an entire outer perimeter of the exterior baffle. In one example, the plurality of cooling tubes are grouped into a plurality of bundle groups of multiple cooling tubes and each exterior baffle of the plurality of exterior baffles is positioned between adjacent bundle groups or a bundle group and one of the exhaust inlet and outlet. In another example, the polymeric sealing material is a fluoropolymer including an alternating copolymer of tetrafluoroethylene and propylene.

In yet another embodiment, an exhaust gas recirculation (EGR) cooler comprises: a plurality of cooling tubes disposed between an exhaust inlet and outlet of the EGR cooler and enclosed within a housing of the EGR cooler, where a first group of the plurality of cooling tubes is positioned proximate to the exhaust inlet and a second group of the plurality of cooling tubes is positioned adjacent to and downstream of the first group, the first group and the second group each positioned between opposite sidewalls of the housing; and a first baffle positioned between a first sidewall of the housing and the first group and a second baffle positioned between a second sidewall of the housing and the first group, where edges of the first baffle and second baffle are positioned forward of the second group relative to the exhaust inlet. In one example, a width of the first group, between an outermost tube of the first group on a first side of the first group and an outermost tube of the first group on a second side of the first group, the second side opposite the first side, is narrower than a width of the second group. In another example, a region of the EGR cooler including the first baffle and second baffle contains no cooling tubes.

In another representation, a system comprises a controller operable to respond to a signal that indicates a determined level of fouling in an EGR cooler by initiating an EGR cooler cleaning mode of operation. In one example, the signal is a sensor signal that indicates one or more of a temperature differential between an inlet and an outlet of the EGR cooler. In another example, the signal is a sensor signal that indicates an absolute temperature of exhaust gas at an outlet of the EGR cooler. In yet another example, the signal is a sensor signal that indicates a pressure drop across the EGR cooler. In one embodiment, the controller includes one or more of the age of an engine coupled to the EGR cooler, the hours of use of the engine, the hours of use of the EGR cooler, a time since an oil change of the engine, a time since a previous cleaning of the EGR cooler, and a duty cycle of the engine to determine whether to initiate the EGR cooler cleaning mode of operation. In one example, the cleaning mode of operation includes over-fueling at least one cylinder of an engine to thereby heat the exhaust gas and clean the EGR cooler. In another example, the cleaning mode of operation includes activating a heater element coupled to the EGR cooler to thereby heat the EGR cooler and clean the EGR cooler. In yet another example, the cleaning mode of operation includes retarding the fuel injection of one or more cylinder of an engine to thereby to pass burning fuel into the exhaust gas and thereby clean the EGR cooler. In another example, the cleaning mode of operation includes providing a signal and thereafter manually cleaning the EGR cooler. In one example, the controller communicates prior to or during the cleaning mode of operation with another locomotive in consist therewith to determine, or prevent, the other locomotive from its entering into a cleaning mode of operation. In another example of the system, the controller determines one or more of an accumulated engine revolutions at low or no load, the load amount, and engine revolutions as a function of MW-hrs as at least one factor in determining whether to initiate the EGR cooler cleaning mode of operation. In yet another example of the system, the controller initiates back pressuring to make an engine perform work (due to pumping losses) and thereby to heat the exhaust gas to a temperature sufficiently high enough to reduce or remove fouling in the EGR cooler.

In yet another representation, an EGR cooler comprises: a plurality of cooling tubes disposed between an exhaust inlet and outlet of the EGR cooler and enclosed within a housing of the EGR cooler; a tube sheet extending across the EGR cooler between opposite first and second interior sidewalls of the housing, where ends of the plurality of cooling tubes are arranged at the tube sheet; and a welded seam between a first beveled edge of the first interior sidewall and a second beveled edge of the tube sheet with substantially 100% weld penetration. The EGR cooler may further comprise one or more of: a plurality of fins positioned between cooling tubes of plurality of cooling tubes, where a fin density of the plurality of fins is smaller proximate to an interior sidewall of the housing of the EGR cooler than at a center of the EGR cooler; the housing surrounding and enclosing the plurality of cooling tubes within the EGR cooler, the housing including a plurality of exterior baffles spaced apart from one another along a length of the EGR cooler, in a direction of exhaust flow through the EGR cooler, each exterior baffle of the plurality of exterior baffles including an aperture arranged in at least one of a top and bottom outer sidewall of the exterior baffle; and a coolant inlet fluidly coupled with the plurality of cooling tubes and arranged at a bottom of the EGR cooler and a coolant outlet fluidly coupled with the plurality of cooling tubes and arranged at a top of the EGR cooler, where coolant passes through the cooling tubes from the coolant inlet to the coolant outlet in a direction opposite of gravity.

In a further representation, an EGR cooler comprises: a plurality of cooling tubes disposed between an exhaust inlet and outlet of the EGR cooler and enclosed within a housing of the EGR cooler; and a plurality of fins positioned between cooling tubes of plurality of cooling tubes, where a fin density of the plurality of fins is smaller proximate to an interior sidewall of the housing of the EGR cooler than at a center of the EGR cooler. The EGR cooler may further comprise one or more of: a tube sheet extending across the EGR cooler between opposite first and second interior sidewalls of the housing, where ends of the plurality of cooling tubes are arranged at the tube sheet, and a welded seam between a first beveled edge of the first interior sidewall and a second beveled edge of the tube sheet with substantially 100% weld penetration; the housing surrounding and enclosing the plurality of cooling tubes within the EGR cooler, the housing including a plurality of exterior baffles spaced apart from one another along a length of the EGR cooler, in a direction of exhaust flow through the EGR cooler, each exterior baffle of the plurality of exterior baffles including an aperture arranged in at least one of a top and bottom outer sidewall of the exterior baffle; and a coolant inlet fluidly coupled with the plurality of cooling tubes and arranged at a bottom of the EGR cooler and a coolant outlet fluidly coupled with the plurality of cooling tubes and arranged at a top of the EGR cooler, where coolant passes through the cooling tubes from the coolant inlet to the coolant outlet in a direction opposite of gravity.

In still another representation, an exhaust gas recirculation (EGR) cooler comprises: a plurality of cooling tubes disposed between an exhaust inlet and outlet of the EGR cooler; and a housing surrounding and enclosing the plurality of cooling tubes within the EGR cooler, the housing including a plurality of exterior baffles spaced apart from one another along a length of the EGR cooler, in a direction of exhaust flow through the EGR cooler, each exterior baffle of the plurality of exterior baffles including an aperture arranged in at least one of a top and bottom outer sidewall of the exterior baffle. The EGR cooler may further comprise one or more of: a plurality of fins positioned between cooling tubes of plurality of cooling tubes, where a fin density of the plurality of fins is smaller proximate to an interior sidewall of the housing of the EGR cooler than at a center of the EGR cooler; a tube sheet extending across the EGR cooler between opposite first and second interior sidewalls of the housing, where ends of the plurality of cooling tubes are arranged at the tube sheet, and a welded seam between a first beveled edge of the first interior sidewall and a second beveled edge of the tube sheet with substantially 100% weld penetration; and a coolant inlet fluidly coupled with the plurality of cooling tubes and arranged at a bottom of the EGR cooler and a coolant outlet fluidly coupled with the plurality of cooling tubes and arranged at a top of the EGR cooler, where coolant passes through the cooling tubes from the coolant inlet to the coolant outlet in a direction opposite of gravity.

In yet another representation, an exhaust gas recirculation (EGR) cooler comprises: a plurality of cooling tubes disposed between an exhaust inlet and outlet of the EGR cooler; a coolant inlet fluidly coupled with the plurality of cooling tubes and arranged at a bottom of the EGR cooler; and a coolant outlet fluidly coupled with the plurality of cooling tubes and arranged at a top of the EGR cooler, where coolant passes through the cooling tubes from the coolant inlet to the coolant outlet in a direction opposite of gravity. The EGR cooler may further comprise one or more of: a plurality of fins positioned between cooling tubes of plurality of cooling tubes, where a fin density of the plurality of fins is smaller proximate to an interior sidewall of the housing of the EGR cooler than at a center of the EGR cooler; a tube sheet extending across the EGR cooler between opposite first and second interior sidewalls of the housing, where ends of the plurality of cooling tubes are arranged at the tube sheet, and a welded seam between a first beveled edge of the first interior sidewall and a second beveled edge of the tube sheet with substantially 100% weld penetration; and the housing surrounding and enclosing the plurality of cooling tubes within the EGR cooler, the housing including a plurality of exterior baffles spaced apart from one another along a length of the EGR cooler, in a direction of exhaust flow through the EGR cooler, each exterior baffle of the plurality of exterior baffles including an aperture arranged in at least one of a top and bottom outer sidewall of the exterior baffle.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. An exhaust gas recirculation (EGR) cooler, comprising:
an exhaust gas inlet and an exhaust gas outlet spaced from the exhaust gas inlet;
a plurality of cooling tubes disposed between the exhaust gas inlet and exhaust gas outlet; and
a baffle positioned proximate to the exhaust gas inlet and interposed between the plurality of cooling tubes and the exhaust gas inlet, where the baffle is configured to direct exhaust gas entering the EGR cooler through the exhaust gas inlet to the plurality of cooling tubes in a defined path.

2. The EGR cooler of claim 1, wherein the baffle is positioned between a sidewall of a housing of the EGR cooler and a first group of cooling tubes of the plurality of cooling tubes that is positioned proximate to the exhaust gas inlet.

3. The EGR cooler of claim 2, wherein the plurality of cooling tubes further comprises a second group of cooling tubes positioned downstream from the first group of cooling tubes, relative to a direction of exhaust gas flow through the EGR cooler, and wherein the baffle is positioned between the inlet and the second group of cooling tubes and between the sidewall and the first group of cooling tubes.

4. The EGR cooler of claim 3, wherein cooling tubes of the second group of cooling tubes are positioned behind, in a downstream direction, the baffle, and wherein there are no cooling tubes positioned within a space occupied by the baffle.

5. The EGR cooler of claim 2, wherein the sidewall is a first sidewall of the housing, and wherein the baffle is a first baffle positioned between the first sidewall of the housing and the first group of cooling tubes and further comprising a second baffle positioned between a second sidewall of the housing and the first group of cooling tubes, where the second sidewall is positioned opposite the first sidewall across a central axis of the EGR cooler.

6. The EGR cooler of claim 1, further comprising a tube sheet extending across the EGR cooler between opposite interior sidewalls of a housing of the EGR cooler, wherein ends of cooling tubes of the plurality of cooling tubes are arranged at the tube sheet.

7. The EGR cooler of claim 6, further comprising a welded seam between a first beveled edge of an interior sidewall of the housing and a second beveled edge of the tube sheet.

8. The EGR cooler of claim 7, wherein the first beveled edge is at an angle of about 45 degrees and the second beveled edge is at an angle of about 25 degrees.

9. The EGR cooler of claim 1, further comprising a plurality of fins positioned between cooling tubes of plurality of cooling tubes, wherein a fin density of the plurality of fins is smaller proximate to an interior sidewall of a housing of the EGR cooler than at a center of the EGR cooler.

10. The EGR cooler of claim 9, wherein the fin density proximate to the exhaust gas inlet and the interior sidewall is less than 50% of a fin density proximate to the exhaust gas outlet.

11. The EGR cooler of claim 1, further comprising exterior baffles extending around an outer perimeter of a housing of the EGR cooler and spaced apart from one another, wherein a sealing material is included around an outer perimeter of the exterior baffles, wherein each exterior baffle of the exterior baffles includes a polymeric sealing material positioned around an entire outer perimeter of the exterior baffle.

12. The EGR cooler of claim 11, wherein the sealing material is fluoropolymer including an alternating copolymer of tetrafluoroethylene and propylene.

13. The EGR cooler of claim 11, further comprising at least one aperture arranged in one or more of the exterior baffles, sized and shaped to provide a drain rate of under 15 minutes.

14. The EGR cooler of claim 1, further comprising a coolant inlet fluidly coupled with the plurality of cooling tubes and arranged at a bottom of the EGR cooler and a coolant outlet fluidly coupled with the plurality of cooling tubes and arranged at a top of the EGR cooler, wherein coolant passes through the cooling tubes from the coolant inlet to the coolant outlet.

15. An exhaust gas recirculation (EGR) cooler, comprising:

a plurality of cooling tubes disposed between an exhaust inlet and outlet of the EGR cooler; and a housing surrounding and enclosing the plurality of cooling tubes within the EGR cooler, the housing including a plurality of exterior baffles spaced apart from one another along a length of the EGR cooler, in a direction of exhaust flow through the EGR cooler, each exterior baffle of the plurality of exterior baffles extending around an entire outer perimeter of the housing and including a polymeric sealing material positioned around an entire outer perimeter of the exterior baffle.

16. The EGR cooler of claim 15, wherein the plurality of cooling tubes are grouped into a plurality of bundle groups of multiple cooling tubes and wherein each exterior baffle of the plurality of exterior baffles is positioned between adjacent bundle groups or between one of the bundle groups and one of the exhaust inlet or outlet.

17. The EGR cooler of claim 15, where the polymeric sealing material is a fluoropolymer including an alternating copolymer of tetrafluoroethylene and propylene.

18. An exhaust gas recirculation (EGR) cooler, comprising:

a plurality of cooling tubes disposed between an exhaust inlet and outlet of the EGR cooler and enclosed within a housing of the EGR cooler, where a first group of the plurality of cooling tubes is positioned proximate to the exhaust inlet and a second group of the plurality of cooling tubes is positioned adjacent to and downstream of the first group, the first group and the second group each positioned between opposite sidewalls of the housing; and a first baffle positioned between a first sidewall of the housing and the first group and a second baffle positioned between a second sidewall of the housing and the first group, where edges of the first baffle and second baffle are positioned forward of the second group relative to the exhaust inlet.

19. The EGR cooler of claim 18, wherein a width of the first group, between an outermost tube of the first group on a first side of the first group and an outermost tube of the first group on a second side of the first group, the second side opposite the first side, is narrower than a width of the second group.

20. The EGR cooler of claim 18, wherein a region of the EGR cooler including the first baffle and second baffle contains no cooling tubes.

* * * * *